US010966042B2

(12) United States Patent
Heilemann et al.

(10) Patent No.: US 10,966,042 B2
(45) Date of Patent: Mar. 30, 2021

(54) METHOD FOR RENDERING LOCALIZED VIBRATIONS ON PANELS

(71) Applicant: The University of Rochester, Rochester, NY (US)

(72) Inventors: Michael C. Heilemann, Rochester, NY (US); Mark F. Bocko, Caledonia, NY (US)

(73) Assignee: THE UNIVERSITY OF ROCHESTER, Rochester, NY (US)

( * ) Notice: Subject to any disclaimer, the term of this patent is extended or adjusted under 35 U.S.C. 154(b) by 0 days.

(21) Appl. No.: 16/799,286

(22) Filed: Feb. 24, 2020

(65) Prior Publication Data

US 2020/0196082 A1 Jun. 18, 2020

Related U.S. Application Data

(63) Continuation-in-part of application No. 16/292,836, filed on Mar. 5, 2019, now Pat. No. 10,609,500, (Continued)

(51) Int. Cl.
*H04S 7/00* (2006.01)
*H04R 5/04* (2006.01)
(Continued)

(52) U.S. Cl.
CPC ..... *H04S 7/30* (2013.01); *H04R 1/2811* (2013.01); *H04R 3/00* (2013.01); *H04R 5/04* (2013.01);
(Continued)

(58) Field of Classification Search
CPC .. H04R 1/2811; H04R 1/403; H04R 2440/01; H04R 2440/05; H04R 2440/07;
(Continued)

(56) References Cited

U.S. PATENT DOCUMENTS 4,328,569 A 5/1982 Trott et al.
5,104,817 A 4/1992 Scott
(Continued)

FOREIGN PATENT DOCUMENTS

WO 97/09842 3/1997
WO 00/33612 6/2000
(Continued)

OTHER PUBLICATIONS

PCT/US16/63121, Nov. 21, 2016, Expired.
(Continued)

*Primary Examiner* — Yogeshkumar Patel
(74) *Attorney, Agent, or Firm* — Ping Wang; Morris, Manning & Martin LLP

(57) ABSTRACT

A loudspeaker system composed of a flexible panel with an affixed array of force actuators, a signal processing system, and interface electronic circuits is described. The system described is capable of creating a pattern of standing bending waves at any location on the panel and the instantaneous amplitude, velocity, or acceleration of the standing waves can be controlled by an audio signal to create localized acoustic sources at the selected locations in the plane of the panel.

20 Claims, 34 Drawing Sheets

Related U.S. Application Data which is a continuation of application No. 15/778,797, filed as application No. PCT/US2016/063121 on Nov. 21, 2016, now Pat. No. 10,271,154.

(60) Provisional application No. 62/259,702, filed on Nov. 25, 2015.

(51) Int. Cl.
*H04R 3/00* (2006.01)
*H04R 1/28* (2006.01)
*H04R 7/04* (2006.01)

(52) U.S. Cl.
CPC ..... *H04R 7/045* (2013.01); *H04R 2440/01* (2013.01); *H04R 2440/05* (2013.01); *H04R 2440/07* (2013.01); *H04R 2499/15* (2013.01)

(58) Field of Classification Search
CPC ..... H04R 2499/11; H04R 2499/15; H04R 29/001; H04R 3/00; H04R 3/002; H04R 5/04; H04R 7/045; H04S 7/30; H04S 7/303
See application file for complete search history.

(56) References Cited

U.S. PATENT DOCUMENTS

| | | | | |
|---|---|---|---|---|
| 5,533,132 | A | 7/1996 | Button | |
| 6,332,029 | B1 | 12/2001 | Azima et al. | |
| 8,879,766 | B1 * | 11/2014 | Zhang | H04R 7/045 381/333 |
| 2004/0240697 | A1 | 12/2004 | Keele | |
| 2005/0013453 | A1 | 1/2005 | Cheung | |
| 2009/0060245 | A1 | 3/2009 | Blanchard et al. | |
| 2011/0062888 | A1 | 3/2011 | Bondy et al. | |
| 2012/0033837 | A1 | 2/2012 | Mitsui et al. | |
| 2012/0232780 | A1 * | 9/2012 | Delson | A63F 13/803 701/400 |
| 2012/0243719 | A1 | 9/2012 | Franklin et al. | |
| 2013/0148827 | A1 * | 6/2013 | Cohen | H02K 33/16 381/111 |
| 2014/0140551 | A1 | 5/2014 | Ramstein | |
| 2015/0086048 | A1 | 3/2015 | Brown et al. | |
| 2016/0073215 | A1 | 3/2016 | De Bruijn et al. | |
| 2016/0119712 | A1 | 4/2016 | Tzirkell-Hancock et al. | |
| 2017/0180855 | A1 | 6/2017 | Lee et al. | |

FOREIGN PATENT DOCUMENTS

| | | |
|---|---|---|
| WO | 02/13574 | 2/2002 |
| WO | 2008/090077 | 7/2008 |
| WO | 2015/119612 | 8/2015 |

OTHER PUBLICATIONS

U.S. Appl. No. 15/778,797, filed May 24, 2018, Patented.
U.S. Appl. No. 16/292,836, filed Mar. 5, 2019, Pending.
International Search Report and Written Opinion dated Nov. 15, 2016, from International Application No. PCT/US2016/047768, 10 pages.
Anderson, D. et al. A Model for the Impulse Response of Distributed-Mode Loudspeakers and Multi-Actuator 1 Panels:, AES Conference Paper 9409, Oct. 29, 2015. nttp:/lwww.aes.org/e-lib/browse.cfm?elib=17966.
International Search Report and Written Opinion dated Feb. 14, 2017, from International Application No. PCT/US2016/063131, 15 pages.
File history of U.S. Appl. No. 16/292,836, filed Mar. 5, 2019.
File history of U.S. Appl. No. 15/778,797, filed May 24, 2018.

* cited by examiner $$a_0 f(n) = b_0 a(n) + b_1 a(n-1) + b_2 a(n-2) - a_1 f(n-1) - a_2 f(n-2) \quad (335)$$

$$a_0 F = (b_0 + b_1 z^{-1} + b_2 z^{-2}) A - (a_1 z^{-1} + a_2 z^{-2}) F \quad (340)$$

$$F = \frac{(b_0 + b_1 z^{-1} + b_2 z^{-2})}{(a_0 + a_1 z^{-1} + a_2 z^{-2})} A \quad (350)$$

BAND LIMITED RECONSTRUCTION (64 MODES)

TARGET SHAPE FUNCTION

PIEZOELECTRIC "PUSHER" ACTUATION

INDIVIDUAL ELECTRODE CONFIGURATION

COMMON GROUND PLANE CONFIGURATION

ISOLATED ELECTRODE CONFIGURATION

STEREOPHONIC - SURROUND
LEFT - RIGHT - CENTER

BIND AUDIO SOURCES
TO IMAGES

WAVE FIELD SYNTHESIS
(RECREATE SOUND FIELD WITH 2D
ARRAY OF SECONDARY SOURCES)

CONSTRUCTION OF PIEZO-ACTUATED OLED DISPLAY

Handset mode

Media mode

METHOD FOR RENDERING LOCALIZED VIBRATIONS ON PANELS

This application is a Continuation-in-part of application Ser. No. 16/292,836, filed on Mar. 5, 2019, which is a Continuation of application Ser. No. 15/778,797, filed on May 24, 2018, now U.S. Pat. No. 10,271,154, which is a 371 application of PCT Application No. PCT/US2016/063121, filed on Nov. 21, 2016, which claims priority of Provisional Application No. 62/259,702, filed on Nov. 25, 2015. The entirety of the aforementioned applications is incorporated herein by reference.

FIELD

This application is related to the field of sound-source rendering, array processing, spatial audio, vibration localization in flat-panel loudspeakers.

BACKGROUND

Loudspeakers that employ bending mode vibrations of a diaphragm or plate to reproduce sound were first proposed at least 90 years ago. The design concept reappeared in the 1960's when it was commercialized as the "Natural Sound Loudspeaker," a trapezoidal shaped, resin-Styrofoam composite diaphragm structure driven at a central point by a dynamic force transducer. In the description of that device, the inventors identified the "multi-resonance" properties of the diaphragm and emphasized that the presence of higher-order modes increased the efficiency of sound production. The Natural Sound Loudspeaker was employed in musical instruments and hi-fi speakers marketed by Yamaha, Fender, and others but it is rare to find surviving examples today. Similar planar loudspeaker designs were patented around the same time by Bertagni and marketed by Bertagni Electroacoustic Systems (BES).

The basic concept of generating sound from bending waves in plates was revisited by New Transducers Limited in the late 1990's and named the "Distributed-Mode Loudspeaker" (DML). Further research on the mechanics, acoustics, and psychoacoustics of vibrating plate loudspeakers illuminated many of the issues of such designs and provided design tools for the further development of the technology, which remains commercially available from Redux Sound and Touch, a descendant of the original New Transducers Limited by Sonance, which can be traced back to the original BES Corporation in the 1970's, and by others including Tectonic Audio Labs and Clearview Audio.

Though flat-panel loudspeakers possess clear advantages over traditional cone loudspeakers in the areas of weight, form-factor, and the potential to serve as low-cost wave field synthesis arrays, they have yet to experience any significant integration into commercial products. The boundary conditions of devices such as smartphones, tablets, and TV's can be difficult to model, as the edges of the panel are rarely fixed uniformly around the perimeter. The sound radiation qualities of localized regions of vibration can exhibit irregularities in frequency response and directivity, as no specification is made regarding the vibration amplitude or spatial response within the vibrating region.

Therefore, what are needed are devices, systems and methods that overcome challenges in the present art, some of which are described above.

SUMMARY

Disclosed herein are systems and methods that describe ways to achieve high quality audio reproduction in a wide range of panel materials and designs. The systems and methods employ a frequency crossover network in combination with an array of force drivers to enable selective excitation of different panel mechanical modes. This system allows different frequency bands of an audio signal to be reproduced by selected mechanical modes of a panel.

The methods described herein demonstrate that localized vibration regions may be rendered on the surface of a panel using filters designed using empirical measurements of the panel's vibration profile. This source rendering technique gives the potential to localize vibrations on the surfaces of displays such as laptop screens, televisions, and tablets, where the boundary conditions make the vibration profile of the system difficult to model in practice. These localized vibrations may serve as primary audio sources on the display screen and dynamically moved to new locations with their respective images, or held stationary on opposite sides of the panel to implement basic stereo imaging.

An aspect of this application is a method for using an array of force actuators to render a desired vibration profile on a panel, comprising the steps of: determining by empiric measurement a vibration profile for the panel in response to excitation of each actuator individually, wherein the measurements are obtained at frequencies within the audio bandwidth; selecting a target spatial vibration profile for the panel; computing a filter for each actuator on the panel, wherein each filter governs the magnitude and phase response of the actuator versus frequency; optimizing each filter for each actuator so that the superposition of the individual actuator responses best approximate the target spatial vibration profile; generating the target spatial vibration profile on the panel by passing an audio signal through the optimized filters to each actuator in the array.

In certain embodiments, the empiric measurement of a vibration profile is obtained by use of a laser vibrometer. In further embodiments, the optimization minimizes the mean-square error or other perceptually weighted error metrics, between the target spatial vibration profile and the vibration profile generated by the superposition of the filtered individual actuator responses. In some embodiments, the actuators are located on a smartphone screen.

In other embodiments, the audio signal is spatially tied to one or more selected from the group consisting of a portion of an image associated with a display and a portion of a video associated with a display. In further embodiments, a frequency crossover network is used to separate the audio signal into different frequency bands, with each frequency band simultaneously reproduced through different target spatial vibration profiles. In specific embodiments, the actuators are located on the back of a monolithic display stack such as an organic light emitting diode (OLED), quantum-dot based light emitting diode such as QLED, e-paper, or other monolithically constructed display. In other embodiments, at least a portion of the plurality of actuators are transparent to a visible part of the electromagnetic spectrum. In additional embodiments, further comprising positioning the plurality of actuators on the panel in a predetermined arrangement, wherein the predetermined arrangement comprises the actuators being arranged around the perimeter of the panel. In other embodiments, actuators are positioned underneath a bezel associated with the perimeter of the panel.

Another aspect of the application is a system for rendering localized vibrations of a panel, comprising: a functional portion of a display; a panel comprising a plurality of actuators forming an arrangement on the panel, wherein the panel is an audio layer and a functional portion of the display is proximate to the audio layer; and a processor and a memory having instructions stored thereon, wherein execution of the instructions by the processor causes the processor to receive a shape function and an audio signal; pass the audio signal through optimized filters to each actuator to generate localized vibrations in the panel, wherein the optimized filters have been determined by the method for using an array of force actuators to render a desired vibration profile on a panel described herein. In certain embodiments, wherein the panel is an audio panel on which a plurality of actuators is arranged, the audio panel being either proximate to the functional portion of the display or one in the same.

In certain embodiments, the audio layer is laminated onto at least a portion the functional portion of the display. In further embodiments, the functional portion of the display is selected from the group consisting of a liquid crystal display (LCD), a light-emitting diode display (LED), and an organic light-emitting diode display (OLED), a quantum-dot based light emitting diode (QLED), a plasma display, e-paper, or a monolithically constructed display. In other embodiments, a spacer element can exist between the audio layer and the functional portion of the display. In specific embodiments, at least a portion of the audio layer is positioned between a touch panel and at least a portion of the functional portion of the display. In additional embodiments, the plurality of actuators are positioned on the panel in a predetermined arrangement, and wherein the pre-determined arrangement comprises a uniform grid-like pattern on the panel. In specific embodiments, a confined region of the functional portion of the display is driven to vibrate and radiate sound. In other embodiments, the entire region of the functional portion of the display is driven to vibrate and radiate sound. In certain embodiments, the predetermined arrangement may exhibit translational or rotational symmetry or may be random.

Another aspect of the application is a method for the generation of an audio scene by methods such as wave field synthesis by rendering localized vibrations of a panel, comprising: receiving an audio signal; receiving one or more distance cues such as the amount of reverberant sound associated with a virtual acoustic source, wherein the virtual acoustic source is representative of an acoustic source behind a panel; computing one or more acoustic wave fronts at one or more predetermined locations on the panel; determining optimized filters for an array of actuators forming an arrangement on a panel according to the method for using an array of force actuators to render a desired vibration profile on a panel described herein; generating localized vibrations in the panel by passing an audio signal through the optimized filters to each actuator in the array. In certain embodiments, the audio signal is spatially tied to one or more portions of at least portion of an image and video associated with a display.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The accompanying drawings, which are incorporated in and constitute a part of this specification, illustrate embodiments and together with the description, serve to explain the principles of the methods and systems:

FIG. 6 shows the left and right channels.

FIG. 7 shows the left, right, and center channels.

FIG. 8 shows the left and right channels.

FIG. 9 shows the left, right, and center channels.

FIG. 12A represents a dynamic force actuator, and FIG. 12B represents a piezoelectric in-plane actuator.

FIG. 18A shows the panel vibrations being controlled to produce the left, right and center channels in a for a surround sound application. FIG. 18B shows the audio sources being bound to a portion of a video or image associated with a display. FIG. 18C shows how the composite wavefronts at the plane of the display from an array of secondary audio sources would be synthesized by the audio display using wave field synthesis to simulate a virtual acoustic source.

FIG. 28, comprising

FIG. 34A shows vibrations in handset mode; FIG. 34B shows vibrations in media mode.

Figure 1:
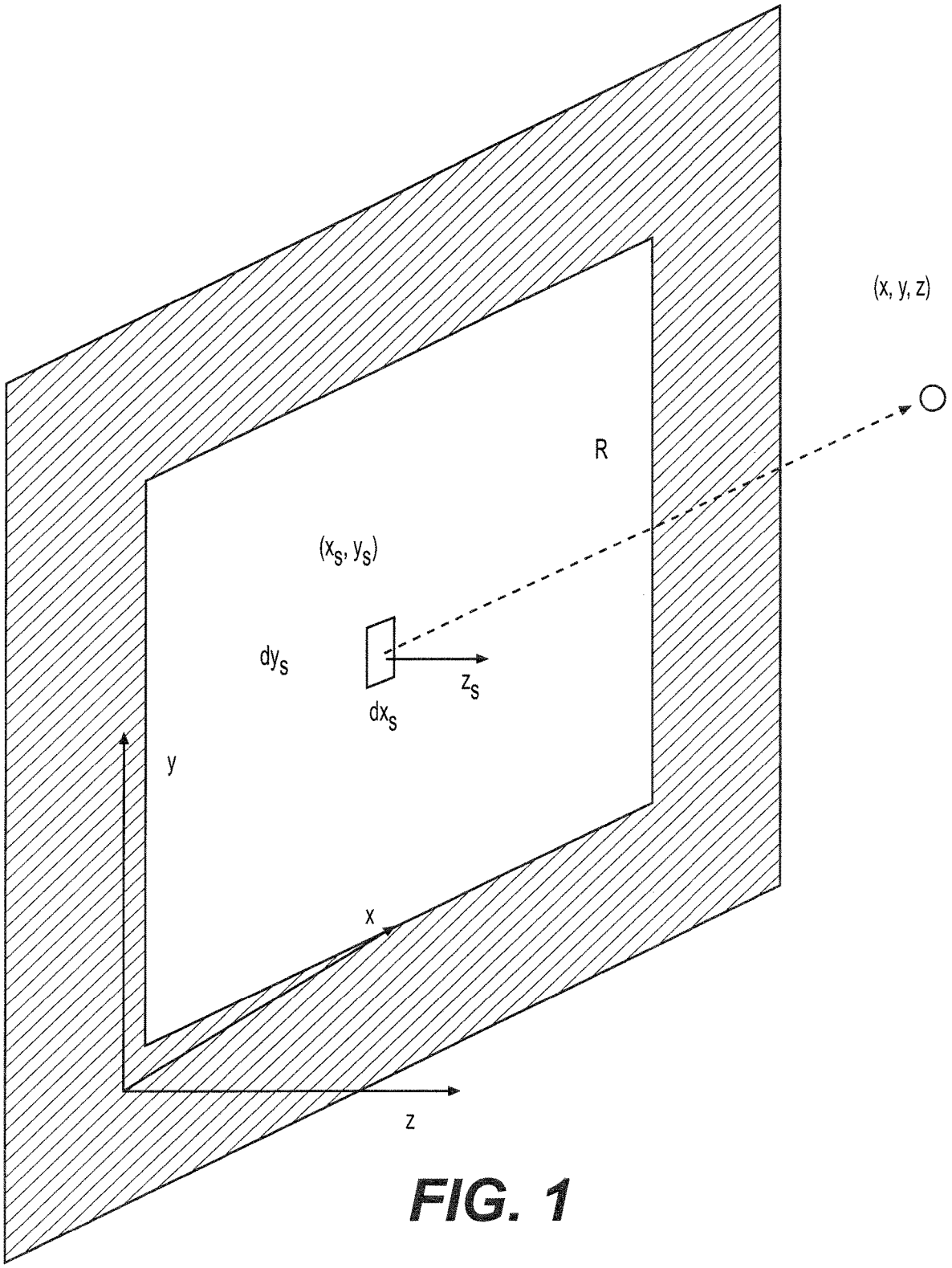
FIG. 1 shows the coordinate definitions for the Rayleigh integral in accordance with the disclosed systems and methods.

While the present disclosure will now be described in detail, and it is done so in connection with the illustrative embodiments, it is not limited by the particular embodiments illustrated in the figures and the appended claims.

DETAILED DESCRIPTION OF THE INVENTION

Reference will be made in detail to certain aspects and exemplary embodiments of the application, illustrating examples in the accompanying structures and figures. The aspects of the application will be described in conjunction with the exemplary embodiments, including methods, materials and examples, such description is non-limiting and the scope of the application is intended to encompass all equivalents, alternatives, and modifications, either generally known, or incorporated herein. Unless otherwise defined, all technical and scientific terms used herein have the same meaning as commonly understood by one of ordinary skill in the art to which this application belongs. One of skill in the art will recognize many techniques and materials similar or equivalent to those described herein, which could be used in the practice of the aspects and embodiments of the present application. The described aspects and embodiments of the application are not limited to the methods and materials described.

As used in this specification and the appended claims, the singular forms "a," "an" and "the" include plural referents unless the content clearly dictates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed that "less than or equal to "the value," greater than or equal to the value" and possible ranges between values are also disclosed, as appropriately understood by the skilled artisan. For example, if the value "10" is disclosed the "less than or equal to 10" as well as "greater than or equal to 10" is also disclosed.

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

As will be appreciated by one skilled in the art, the methods and systems may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including hard disks, CD-ROMs, optical storage devices, or magnetic storage devices.

Embodiments of the methods and systems are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

Background and Theory

Disclosed herein are systems and methods that describe effecting spatial and temporal control of the vibrations of a panel, which in turn can enable control of the radiated sound. The Rayleigh integral can be employed to compute the sound pressure $p(\vec{x}, t)$ measured at a point in space $\vec{x}$, distant from the panel, $$p(\vec{x}, t) = \frac{p}{2\pi}\int_s\int \frac{\ddot{z}_s(x_s', y_s, t - R/c)}{R}\,dx_s dy_s \tag{1}$$

where $\ddot{Z}_s(X_s, Y_s, t-R/c)$ is the acceleration of the panel normal to its surface at a point $(x_S, y_s)$ ($\chi_s$ in the plane of the panel, R is the distance from $(X_s, Y_s)$ to a point in space, $\vec{x}=(x, y, z)$, at which the sound pressure is measured, ρ is the density of air, and c is the speed of sound in air. FIG. 1 shows the coordinate definitions for the Rayleigh integral of (1). Note that $(x_S, y_S)$ is used to refer to points on the panel surface and $z_S$ is the displacement of the panel normal to its surface. The panel is assumed to be placed in an infinite baffle so the integral need only extend over the front surface of the panel. It is possible to have multiple sound sources distributed in the plane of the panel and due to the linearity of the Rayleigh integral, these may be treated independently. However, if different sources overlap spatially there exists the potential for intermodulation distortion, which also may be present in conventional loudspeakers. This may not have a large effect but it can be avoided altogether by maintaining spatial separation of different sound sources, or by spatially separating low frequency and high frequency audio sources.

The collection of sources may be represented by a panel acceleration function $\ddot{Z}_s(x_S, y_S, t)$ that can be factored into functions of space, $a_{0,k}(x_s, y_s)$ and functions of time, $s_k(t)$. The sum of the individual sources, assuming that there are K sources, gives the overall panel acceleration normal to its surface:

$$\ddot{z}_s(x_s y_s, t) = \sum_{k=1}^{K} a_{0,k}(x_s, y_s)s_k(t). \tag{2}$$

In the following a single audio source is considered so the subscript k is not included. Thus, $$\ddot{z}_s(x_s, y_s, t) = a_0(x_s, y_s)s(t), \tag{3}$$

where $a_0(x_s, y_s)$ is the "shape function" corresponding to the desired spatial pattern of the panel vibrations.

The shape function may be a slowly changing function of time, e.g., an audio source may move in the plane of the audio display. If the audio source is assumed to be moving slowly, both in comparison to the speed of sound and to the speed of the propagation of bending waves in the surface of the plate, then in the moving source case $a_0(x_s,y_s,t)$ can be a slowly varying function of time. The rapid, audio-frequency, time dependence can then be represented by the function s(t). This is analogous to the well-known rotating-wave approximation. However, in order to simplify the following discussion, $a_0(x_s,y_s)$ is treated as time-independent.

Any shape function can be represented by its two-dimensional Fourier series employing the panel's bending normal modes as the basis functions. In practice, the Fourier series representation of a panel's spatial vibration pattern will be band-limited. This means that there can be a minimum (shortest) spatial wavelength in the Fourier series. To force the panel to vibrate (in time) in accordance with a given audio signal, s(t), while maintaining a specified shape function can require that the acceleration of each normal mode in the Fourier series follow the time dependence of the audio signal. Each of the panel normal modes may be treated as an independent, simple harmonic oscillator with a single degree-of-freedom, which may be driven by an array of driver elements (also interchangeably referred to as force actuators herein). The driver elements can be distributed on the panel to drive the acceleration of each mode, making it follow the audio signal s(t). A digital filter for computing the modal forces from the audio signal is derived below as well.

To independently excite each panel normal mode can require the collective action of the array of driver elements distributed on the panel. The concept of modal drivers where each panel normal mode may be driven independently by a linear combination of individual driver elements in the array will be discussed in more detail below. A review of the bending modes of a rectangular panel is first provided.

Normal Modes and Mode Frequencies of a Rectangular Plate

It is assumed that the panel comprises a rectangular plate with dimensions $L_x$ and $L_y$ in the x and y directions. The equation governing the bending motion of a plate of thickness h may be found from the fourth-order equation of motion:

$$D\nabla^4 z + \mathrm{ph}\frac{\partial^2 z}{\partial t^2} + \frac{\partial z}{\partial z} = 0 \tag{4}$$

in which D is the plate bending stiffness given by, $$D = \frac{Eh^3}{12(1-\nu^2)}. \tag{5}$$

In the above equation, b is the damping constant (in units of Nt/(m/sec)/m$^2$), E is the elastic modulus of the plate material (Nt/m$^2$), h is the plate thickness (m), ρ is the density of the plate material (kg/m$^3$), and ν is Poisson's ratio for the plate material. When the edges of the plate are simply supported, the normal modes are sine waves that go to zero at the plate boundaries. The normalized normal modes are given by, $$\varphi_{mn(x_S,y_S)} = \sin(m\pi x_s/L_x)\sin(n\pi y_s/L_y) \tag{6}$$

The normalization of the modes can be such that, for a plate of uniform mass density throughout, $$\int_0^{L_x} dx_s \int_0^{L_y} dy_s\, ph\varphi_{mn}(x_s', y_s)\varphi_{rs}(x_s, y_s) = M\delta_{mr}\delta_{ns};\ \delta_{mr} = \begin{bmatrix} 0 \text{ if } m \neq r \\ 1 \text{ if } m = r \end{bmatrix} \tag{7}$$

where M is the total mass of the plate, $M=\rho h L_x L_y=\rho h A$, where $A=L_x L_y$ is the plate area.

The speed of propagation of bending waves in a plate may be found from (4). Ignoring damping for the moment, the solution of (4) shows that the speed of propagation of a bending wave in the plate is a function of the bending wave frequency, f:

$$c = \left[2\pi f\left(\frac{D}{\rho h}\right)^{1/2}\right]^{1/2}. \tag{8}$$

This expression may be rewritten as, $$c = c_0\left(\frac{f}{f_0}\right)^{1/2} \tag{9}$$

where $c_0$ is the bending wave speed at a reference frequency $f_0$.

As an example, aluminosilicate glass has the following physical parameters: $E=7.15\times10^{10}$ Nt/m$^2$, $\nu=0.21$, and $\rho=2.45\times10^3$ kg/m$^3$ (all values approximate). Assuming a panel thickness of approximately 0.55 mm, $c_0=74.24$ m/sec at $f_0=1000$ Hz (all values approximate), the bending wave speed can then be found at any frequency using (9).

For example, considering an approximately 20,000 Hz bending wave traversing a panel at a speed of about 332 m/sec; the wavelength of an approximately 20 kHz bending wave (the upper limit of the audio range) is then $\nu=c/f=0.0166$ m (1.66 cm). To excite an approximately 20 kHz bending wave in the plate, the Nyquist sampling criterion requires that there be two force actuators per spatial wavelength. In this example the force actuator array spacing required to drive modes at approximately 20 kHz would be about 0.8 cm. It can be possible to drive lower frequency modes above their resonant frequencies to generate high frequency sound radiation; however, if the force actuator spacing is larger than the spatial Nyquist frequency for the highest audio frequency there can be uncontrolled high frequency modes.

The frequency of the (m,n) mode is given by, $$f_{m,n} = \frac{c}{2}\left(\left(\frac{m}{L_x}\right)^2 + \left(\frac{n}{L_y}\right)^2\right)^{1/2}; \tag{10}$$

however, since the speed of a bending wave is frequency dependent substituting (9) into (10) this can be rewritten as, $$f_{m,n} = \frac{c_0^2}{4f_0}\left(\left(\frac{m}{L_x}\right)^2 + \left(\frac{n}{L_y}\right)^2\right). \tag{11}$$

Equations (6) and (11) give the mode shapes and mode frequencies for the normal modes of a rectangular plate with simply supported edges.

Control of the Panel Shape Function

The truncated two-dimensional Fourier series using the panel normal modes as the basis functions provides a spatially band-limited representation of a panel shape function, $$a_0(x_s, y_s) = \sum_{m=1}^{M} \sum_{n=1}^{N} a_{mn}\varphi_{mn}(x_s, y_s), \tag{12}$$

where $a_{mn}$ is the amplitude of the (m,n) panel normal mode. As discussed above, the Fourier series is truncated at an upper limit (M,N) which can determine the spatial resolution in the plane of the panel of the shape function. A specific shape function can be created on the plate and then be amplitude modulated with the audio signal. According to the Rayleigh integral, (1), the acoustic sound pressure is proportional to the normal acceleration of the plate, so the acceleration of each mode follows the time-dependence of the audio signal, $$\ddot{u}_{mn}(t)=a_{mn}s(t). \tag{13}$$

To find the equation of motion for the mode amplitudes, the plate normal displacement can be first written in terms of time dependent mode amplitudes, $$z(x_s, y_s, t) = \sum_{m,n} u_{mn}(t)\sin(m\pi x_s/L_x)\sin(n\pi y_s/L_y)e^{j\omega t}. \tag{14}$$

This can then be substituted into the equation for the bending motion of a plate with an applied force:

$$DV^4 z(x_s, y_s, t) + \rho h\frac{\partial^2 z(x_s, y_s, t)}{\partial t^2} + b\frac{\partial z(x_s, y_s, t)}{\partial t} = P(x_s, y_s, t) \tag{15}$$

where $P(x_s, y_s, t)$ is the normal force per unit area acting on the plate. The force can also be expanded in a Fourier series:

$$P(x_s, y_s, t) \equiv \sum_{mn} p_{mn}\ \sin(m\pi x_s/L_x)\sin(n\pi y_s/L_y)e^{j\omega t}. \tag{16}$$

Substituting into the equation of motion, equation (15), the frequency domain plate response function is:

$$U_{mn}(\omega) = \frac{1}{\rho h}\left(\frac{1}{\omega_{mn}^2 - \omega^2 + j\frac{\omega\omega_{mn}}{Q_{mn}}}\right)P_{mn}(\omega) \tag{17}$$

where $U_{mn}(\omega)$ and $P_{mn}(\omega)$ are the frequency domain normal mode amplitude and the force per unit area acting on the mode, $\omega_{mn}=2\pi f_{mn}$ is the angular frequency of the (m,n) mode, and $Q_{mn}=\omega_{mn}$ M/b is the quality factor of the (m,n) plate mode. This can be re-written in terms of the force acting on the (m,n) mode, $F_{mn}(\omega)=AP_{mn}(\omega)$, as $$U_{mn}(\omega) = \frac{1}{\rho hA}\left(\frac{1}{\omega_{mn}^2 - \omega^2 + j\frac{\omega\omega_{mn}}{Q_{mn}}}\right)P_{mn}(\omega). \tag{18}$$

To find the discrete time filter equivalent for this system, the system response can be represented in the Laplace domain (where $j\omega \rightarrow s$) and a bilinear transformation can be employed to transform to the z-domain. Because the force required to give a target modal acceleration is desired, (18) can be re-written in the Laplace domain and rearranged to find the force required to achieve a target modal acceleration, $$P_{mn}(s) = \left(\frac{s^2 + s\frac{\omega_{mn}}{Q_{mn}} + \omega_{mn}^2}{s^2}\right)MA_{mn}(s), \tag{19}$$

where $A_{mn}(s)=s^2U_{mn}(s)$, and $M=\rho hA$ is the panel mass as before. Then, making the substitution $$s = \frac{2}{\tau}\frac{z-1}{z+1},$$

using T for the discrete time sampling period, the z-domain system response can be defined by $$F_{mn}(z)=H_{mn}(z)A_{mn}(z). \tag{20}$$

The system response is second order and may be written as, $$H_{mn}(s) = \frac{b_0 + b_1 z^{-1} + b_2 z^{-2}}{a_0 + a_1 a^{-1} + a_2 z^{-2}} \tag{21}$$

where the coefficients are given by the following expressions. Note that the mode number notation in the coefficients can be suppressed, but there is a unique set of coefficients for each mode:

$$\begin{aligned} a_0 &= 1\ b_0 = M\left(1 + \frac{\omega_{mn}}{Q_{mn}}\frac{T}{2} + \omega_{mn}^2\frac{T^2}{4}\right) \\ a_1 &= -2\ b_1 = M\left(-2 + \omega_{mn}^2\frac{T^2}{4}\right) \\ a_2 &= 1\ b_2 = M\left(1 - \frac{\omega_{mn}}{Q_{mn}}\frac{T}{2} + \omega_{mn}^2\frac{T^2}{4}\right) \end{aligned} \tag{22}$$

The system then may be represented by a second order, infinite impulse response filter as follows, $$a_0f(k)=b_0a(k)+b_1a(k-1)+b_2a(k-2)-a_1f(k-1)-a_2f(k-2) \tag{23}$$

where f(k) represents the discrete time sampled modal force and a(k) is the discrete time sampled target modal acceleration; once again the (m,n) mode indices are suppressed to unclutter the notation.

One aspect of the above filter is that the system transfer function as defined in (21) and (22) has a pair of poles at z=1, and thus diverges at zero frequency. That is, the force required to produce a static acceleration goes to infinity. Since the audio frequency range is of interest, and it does not extend below 20 Hz, the problem can be addressed by introducing a high-pass filter into the system response. In practice this can be achieved simply by replacing the two poles at z=1 with a complex conjugate pair of poles slightly off the real axis and inside of the unit circle.

Application of Modal Forces

The last step is to find the individual forces that must be applied by the force actuator array to obtain the required modal drive forces. Assuming that there is a set of force actuators distributed on the plate at locations, $\{x_r, y_s\}$ where r=1 . . . R, and s=1 . . . S. There are R actuators in the x-dimension and S actuators in the y-dimension, and because rectangular plates are being considered, R and S will be, in general, different. The total discrete time force that should be applied at each actuator location $(x_r, y_s)$ is given by, $$f(x_r, y_s, k) = \sum_{mn} f_{mn}(k)\ \varphi_{mn}(x_r, y_s). \tag{24}$$

In the notation introduced $f(x_r, y_s, k)$ refers to the force applied at location $(x_r, y_s)$ at the discrete time k. This can be computed by summing over the modal contributions, $f_{mn}(k)$, each one weighted by the (m,n) normal mode amplitude at the location $(x_r, y_s)$ on the plate.

Figure 2:
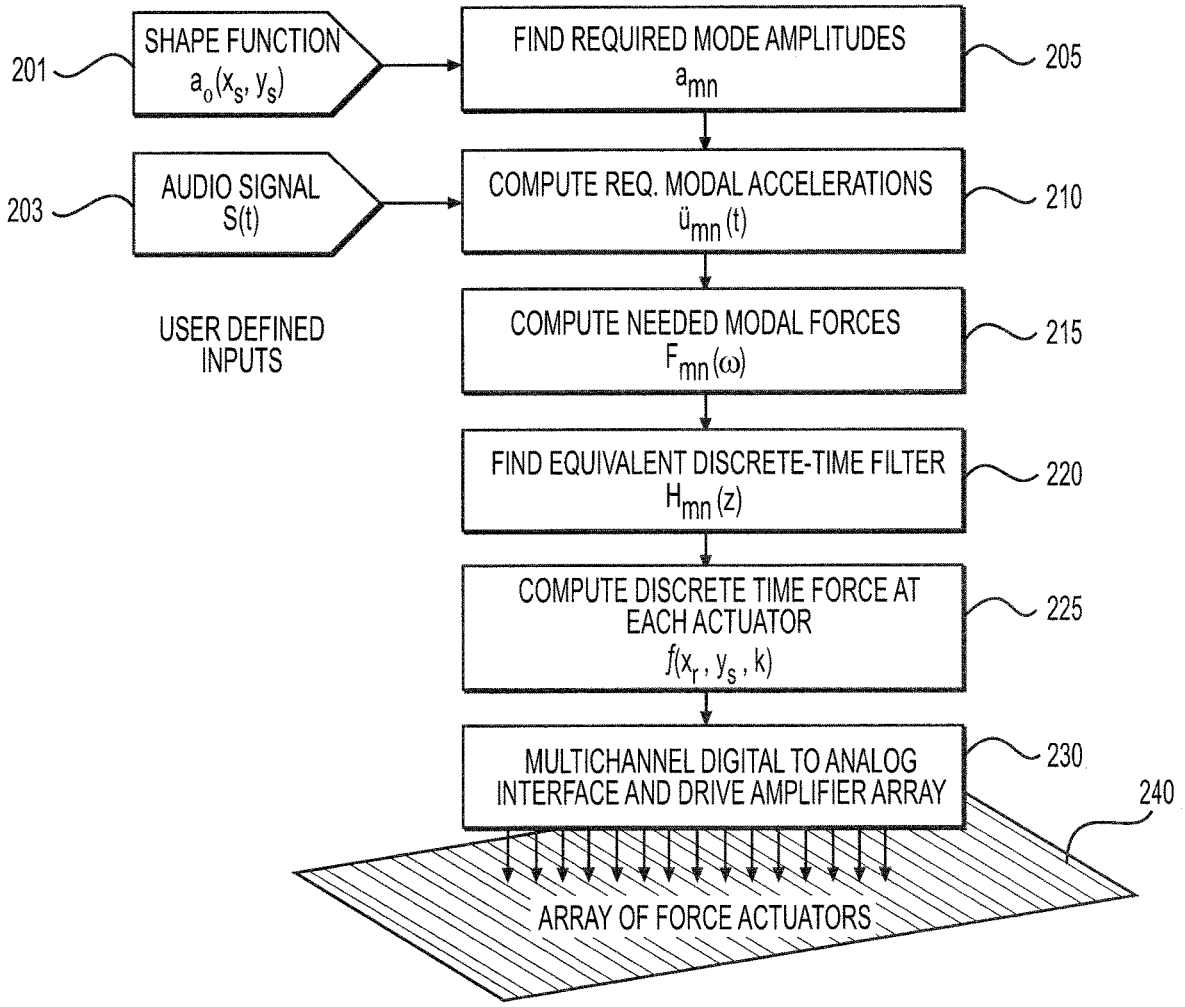
FIG. 2 shows a flowchart detailing the steps in the computation of the drive signals for each driver element in an array of driver elements to achieve control of the spatial and temporal vibrations of a plate panel.

The preceding discussion is a general description of the computational steps required to effect spatial and temporal control of a plate employing an array of force actuators coupled to the plate. The method is summarized in the flowchart of FIG. 2, with reference to specific equations in the above analysis. Broadly speaking, as indicated in FIG. 2, a user inputs the audio signal to be reproduced and the desired shape function, which gives the intended spatial distribution of panel vibrations. The output of the computational steps is the discrete-time signal that must be applied to each driver element (e.g. force actuator) in the array of driver elements to achieve the desired shape function and temporal plate response. The final output of the system is a multi-channel analog signal that is used to drive each of the driver elements in the array.

More specifically, first, in 201 and 203, a shape function and an audio signal is received; next, a band-limited Fourier series representation of the shape function 205 is determined. Next, one or more modal accelerations from the audio signal and the band-limited Fourier series representation of the shape function 210 are computed. Then, one or more modal forces needed to produce the one or more modal accelerations 215 is computed. The computation of the one or more modal forces can include using a frequency domain plate-bending mode response. Next, a response associated with a discrete-time filter corresponding to the frequency domain plate bending mode response 220 is determined. The one or more modal forces to determine a force required at each driver element in a plurality of driver elements 225 is summed. Finally, a multichannel digital to analog conversion and amplification of one or more forces required at each driver element in the plurality of driver elements 230, and drive a plurality of amplifiers with the converted and amplified electrical signals required at each driver element in the plurality of driver elements 240 is performed.

Figure 3:
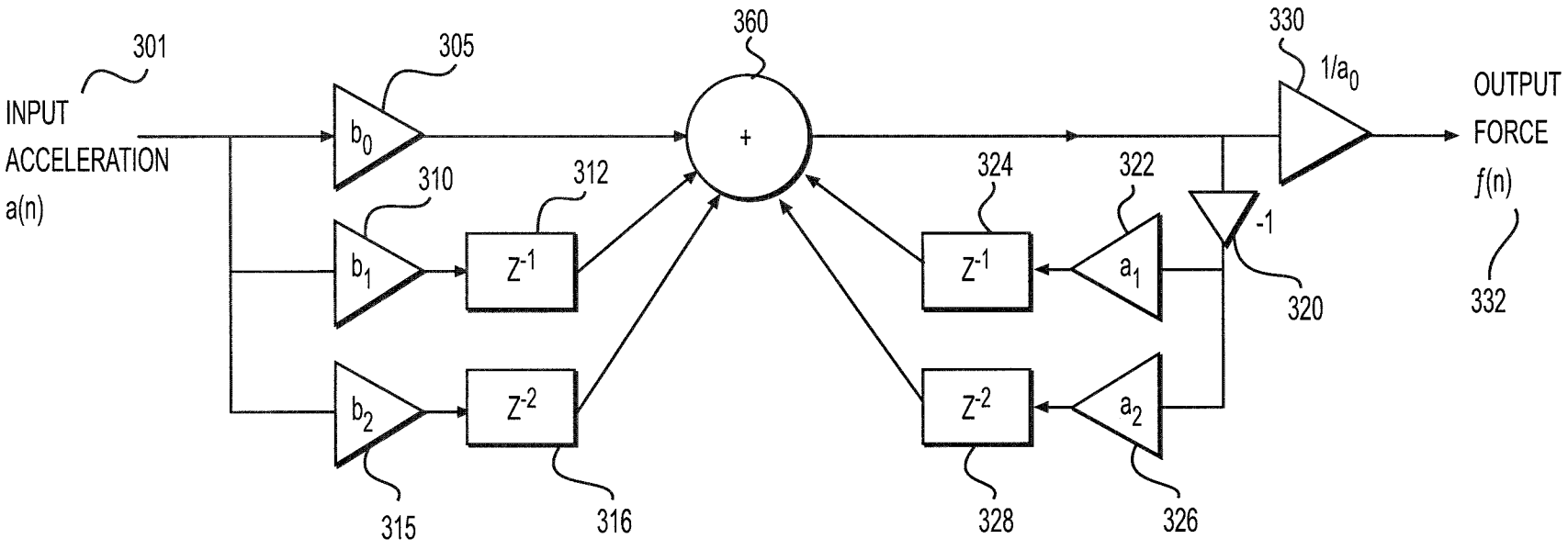
FIG. 3 represents a flow diagram of the implementation of the discrete-time filter that enables the computation of the required modal force to achieve a target acceleration for a given plate mode.

FIG. 3 represents a flow diagram of the implementation of the discrete-time filter corresponding to the bending mode response $H_{mn}(z)$. In 301 the acceleration a(n) is inputted into the filter. The input is then differentially multiplied by coefficients $b_0$, $b_1$, and $b_2$ (305, 310, and 315), and delayed by elements 312 and 316, and summed in 360. The output of the summing node (360) is also multiplied by coefficients $a_1$ and $a_2$, and then delayed by elements 324 and 328. This quantity is subtracted from the summed portion in the previous step. The processed input is then multiplied by $1/a_0$ (330) and that yields the output f(n) force 332. The equivalent mathematical description of the flow diagram in the z-domain is shown in the equations (335, 340, and 350) of FIG. 3. Specifically equation 335 shows the discrete time representation of the flow diagram described above. Equation 340 shows Z-transformed version of equation 335, and equation 350 shows the resulting transfer function in the Z-domain that can be derived from 340.

Figure 4B:
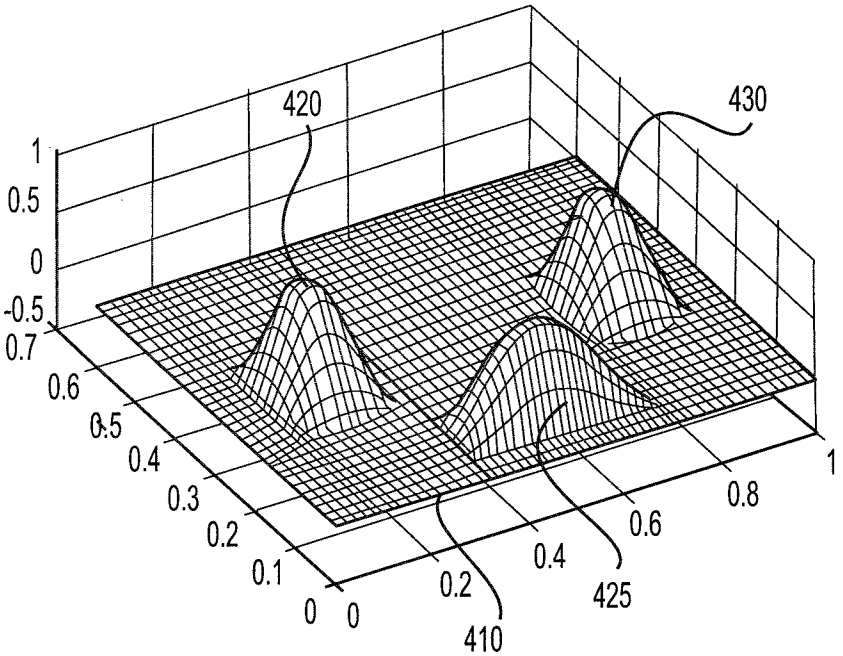
FIG. 4B shows the band-limited two-dimensional Fourier series reconstruction of the target shape function.
Figure 4A:
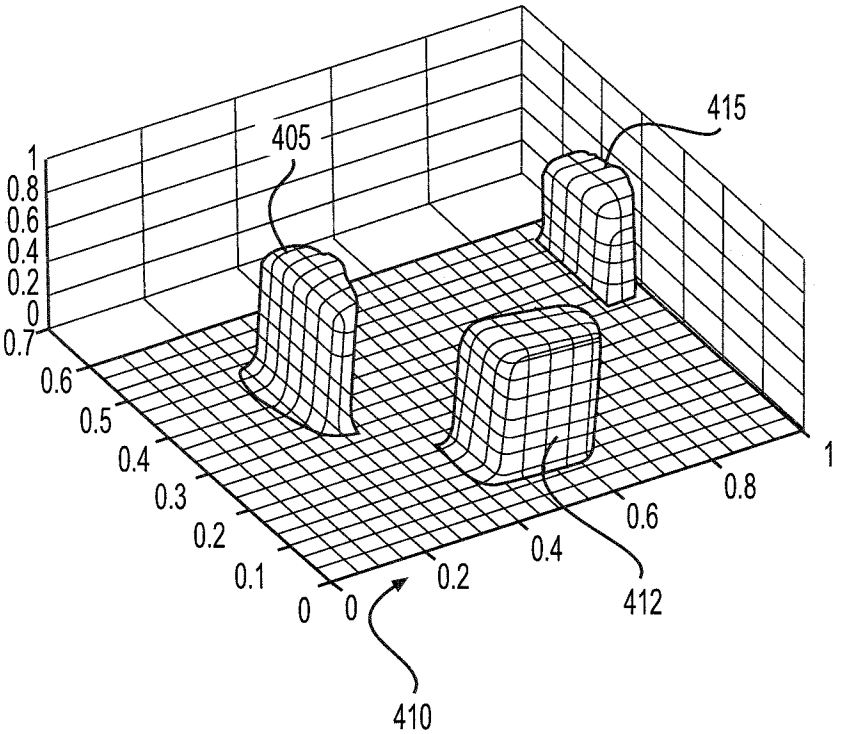
FIG. 4A shows an idealized target shape function for a plate panel.
Figure 5B:
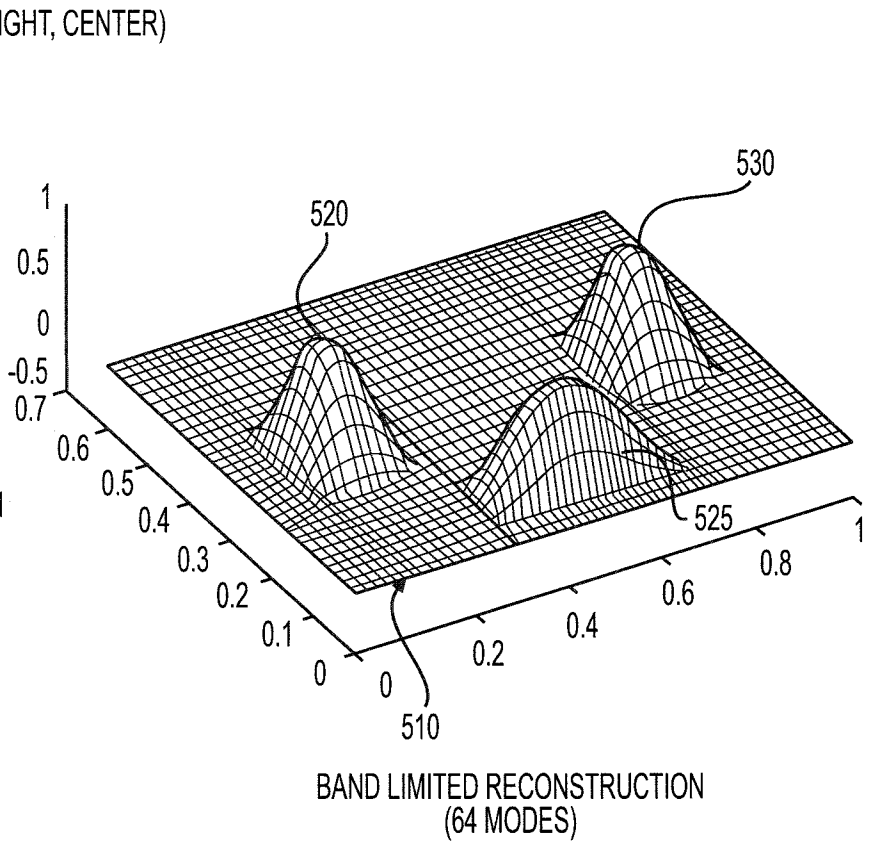
FIG. 5B shows a band-limited reconstruction of the target shape function. In the case shown the reconstruction employs the lowest 64 modes.
Figure 5A:
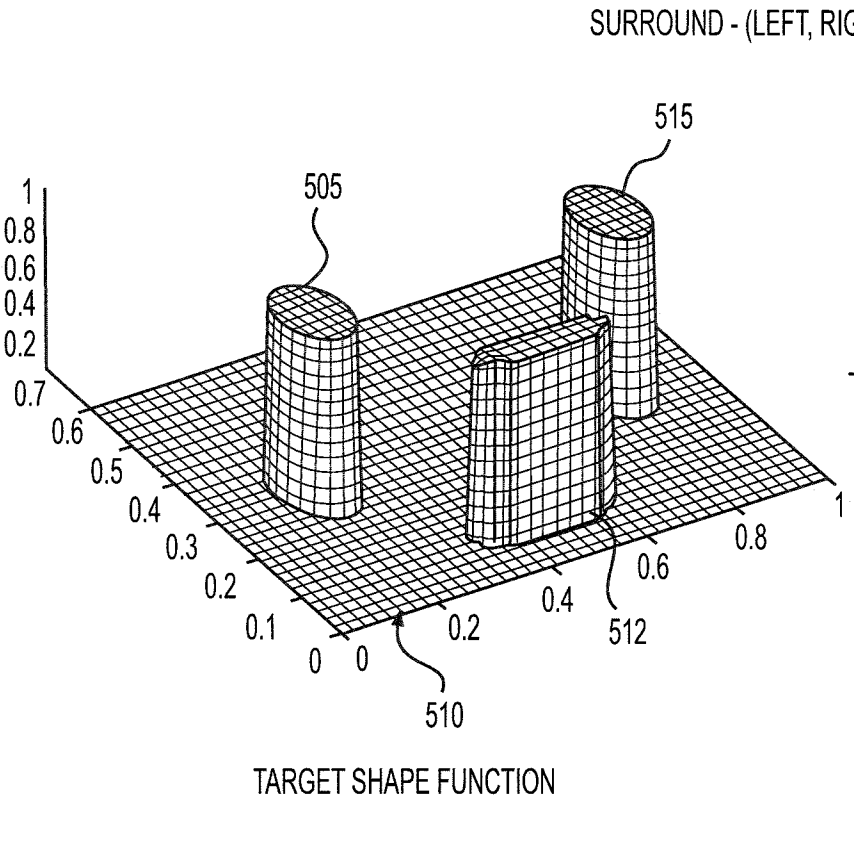
FIG. 5A shows an idealized target shape function for a plate panel.

FIGS. 4A and 4B each shows idealized target shape function for a panel on the left and the band-limited two-dimensional Fourier series reconstruction of the target shape function is shown on the right. Normal modes up to the (10,10) mode are included in the Fourier series reconstruction. The figure shows an example of a band-limited Fourier reconstruction of a target panel shape function. In the example shown, the target shape function shown in FIG. 4A on the left has the panel vibrations (and the resulting sound radiation) confined to left (405), right (415), and center regions (412) of the panel (410), such as for the front three channels of a surround sound system. A band-limited reconstruction (420, 425, and 430) of the specified spatial shape function is shown in FIG. 4B on the right. Only modes up to the tenth are included in the Fourier reconstruction.

Figure 6:
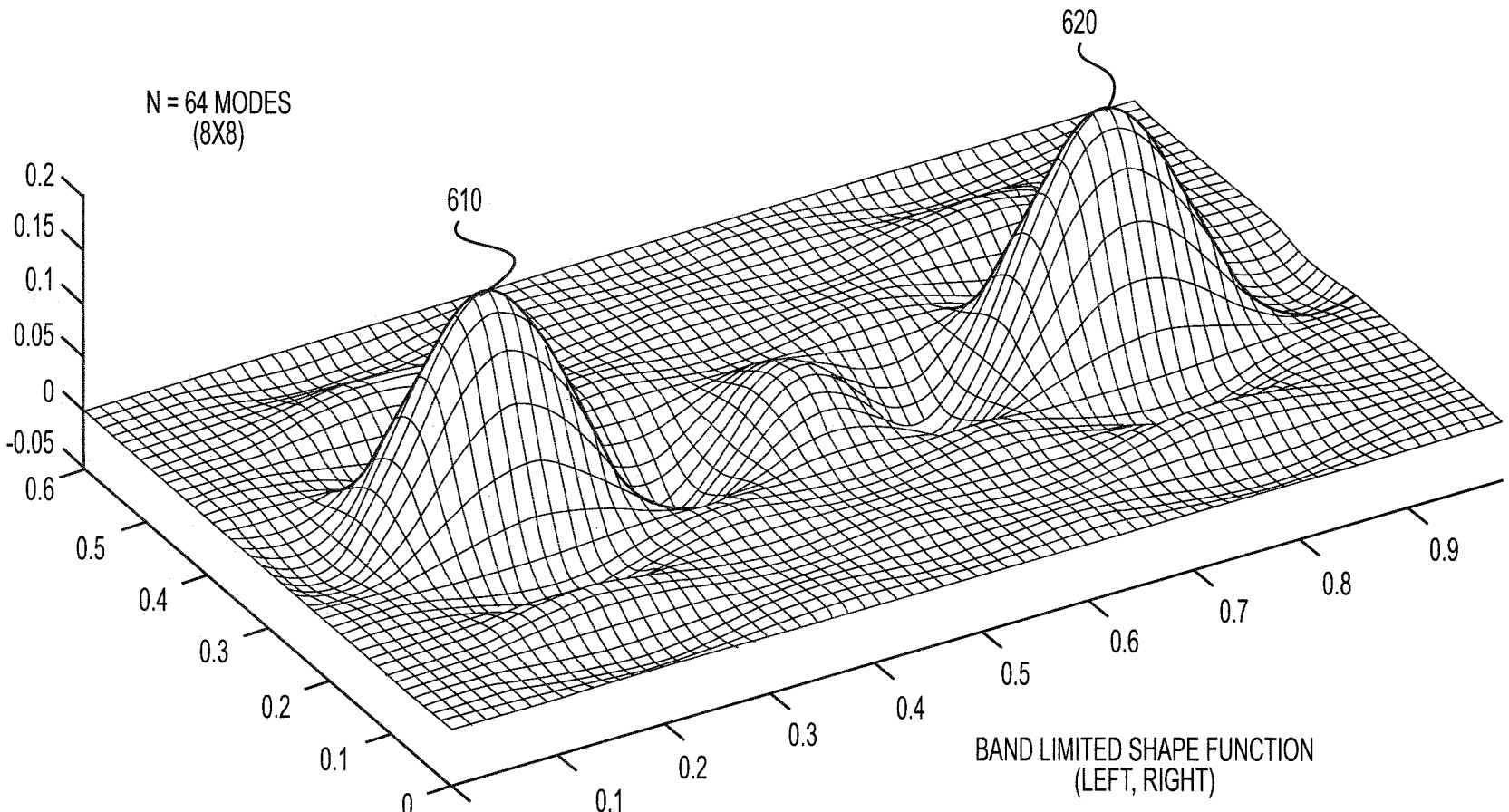
FIG. 6 illustrates a band-limited reconstruction (for the lowest 64 modes) for stereo sound reproduction.
Figure 7:
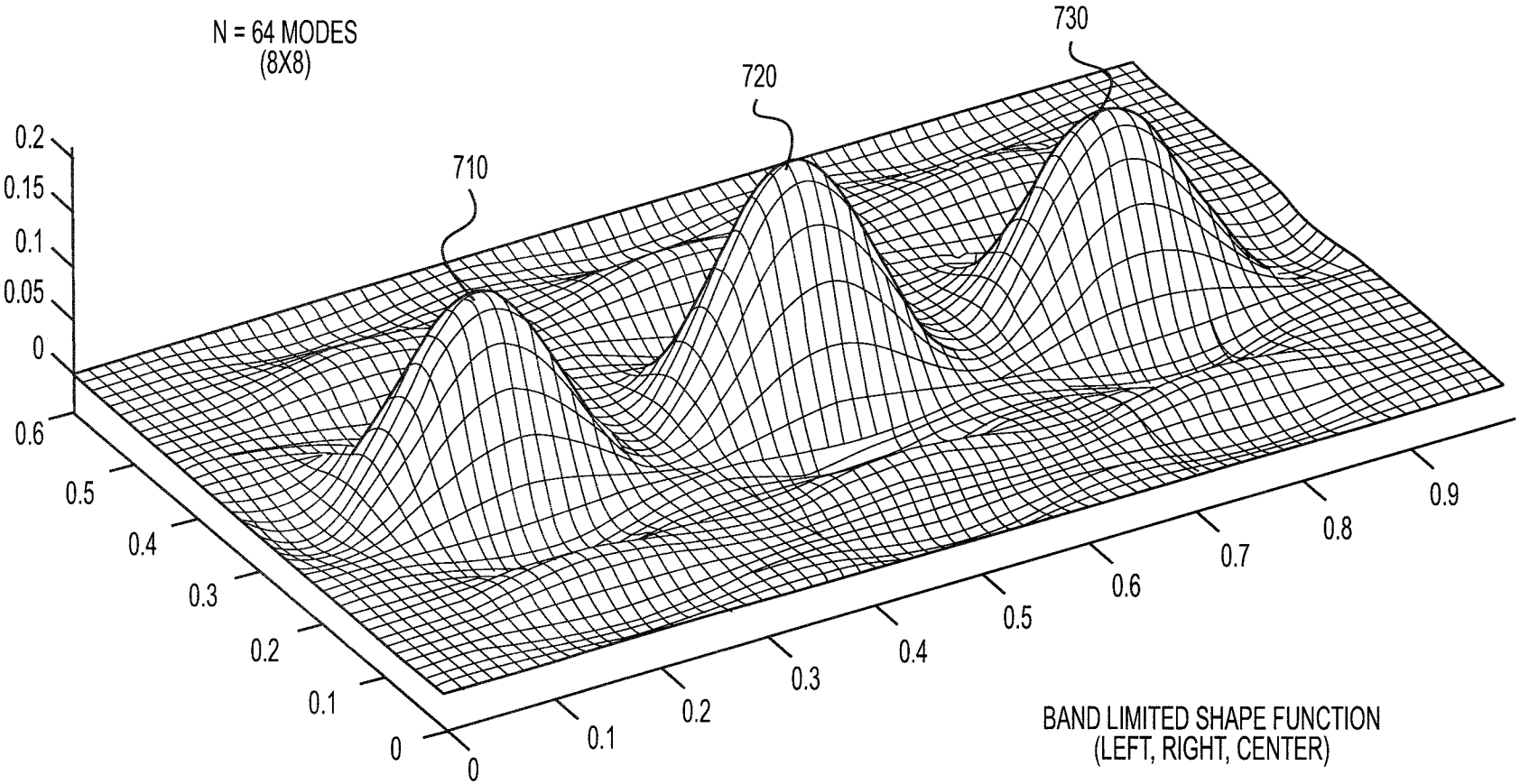
FIG. 7 illustrates a band-limited reconstruction (for the lowest 64 modes) for surround sound reproduction.
Figure 8:
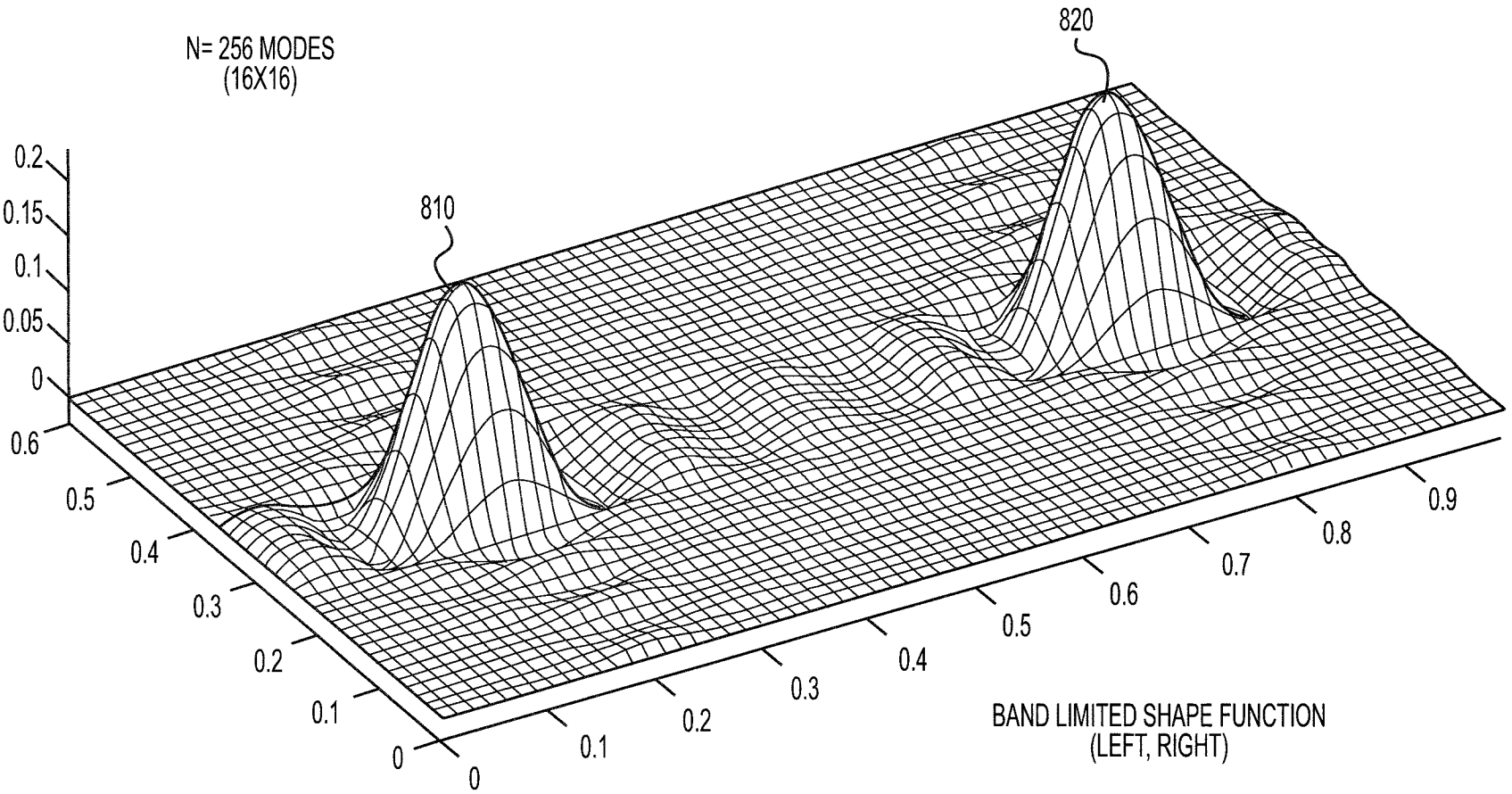
FIG. 8 illustrates a band-limited reconstruction (for the lowest 256 modes) for stereo sound reproduction.
Figure 9:
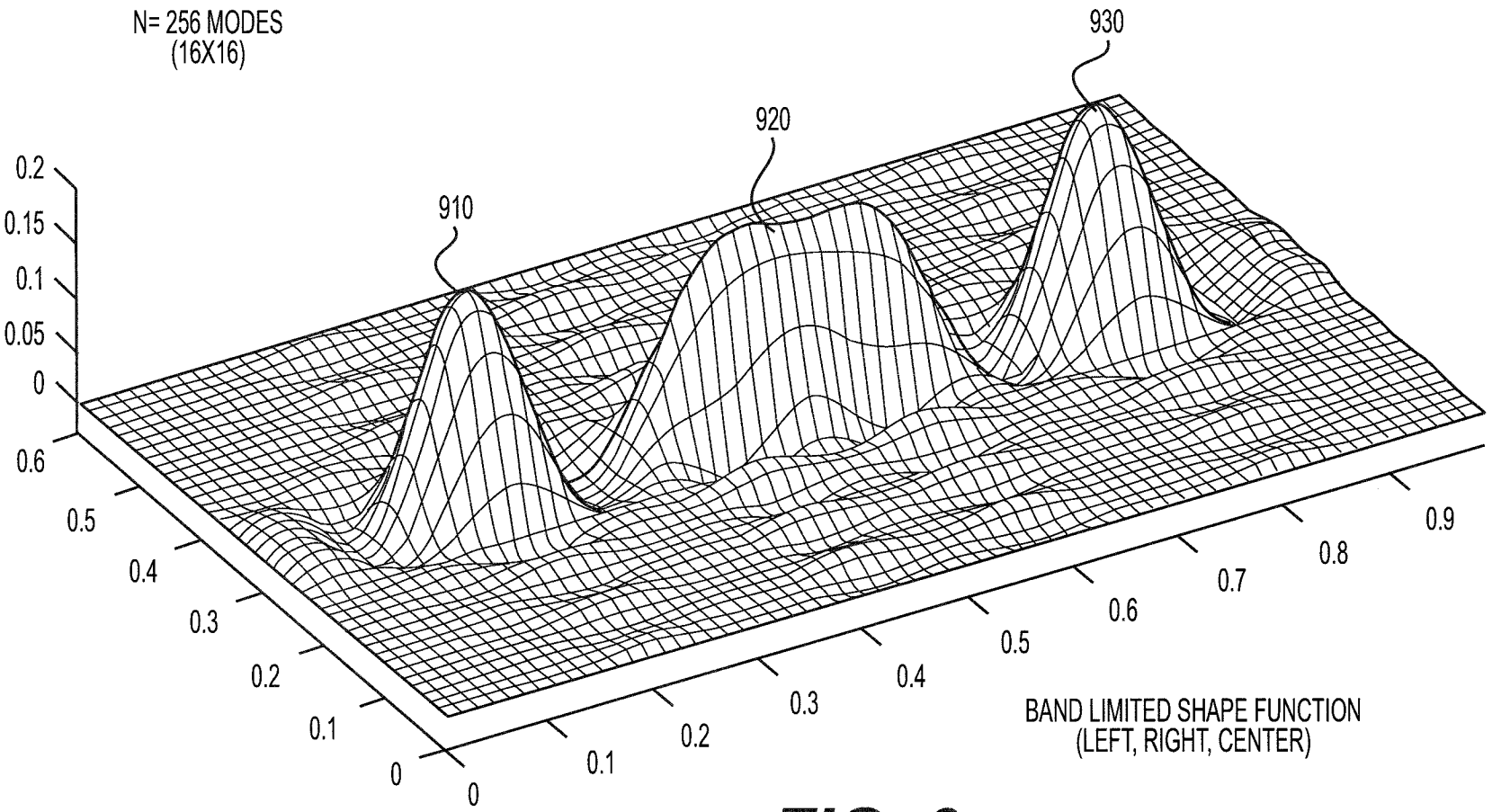
FIG. 9 illustrates a band-limited reconstruction (for the lowest 256 modes) for surround sound reproduction.

FIGS. 5-9 show various band-limited reconstruction of a target shape function. In FIG. 5A, the target vibration pattern has the panel vibrations confined to left (505), right (515), and center regions (512) of the panel (510); the band-limited reconstruction (520, 525, and 530) (in FIG. 5B) employs the lowest 64 modes. FIG. 6 illustrates a band-limited reconstruction (for the lowest 64 modes) for stereo sound reproduction. FIG. 6 shows the left (610) and right (620) channels. FIG. 7 illustrates a band-limited reconstruction (for the lowest 64 modes) for surround sound reproduction. FIG. 7 shows the left (710), right (730), and center (720) channels. FIG. 8 illustrates a band-limited reconstruction (for the lowest 256 modes) for stereo sound reproduction. FIG. 8 shows the left (810) and right (820) channels. FIG. 9 illustrates a band-limited reconstruction (for the lowest 256 modes) for surround sound reproduction. FIG. 9 shows the left (910), right (930), and center (920) channels.

Figure 10A:
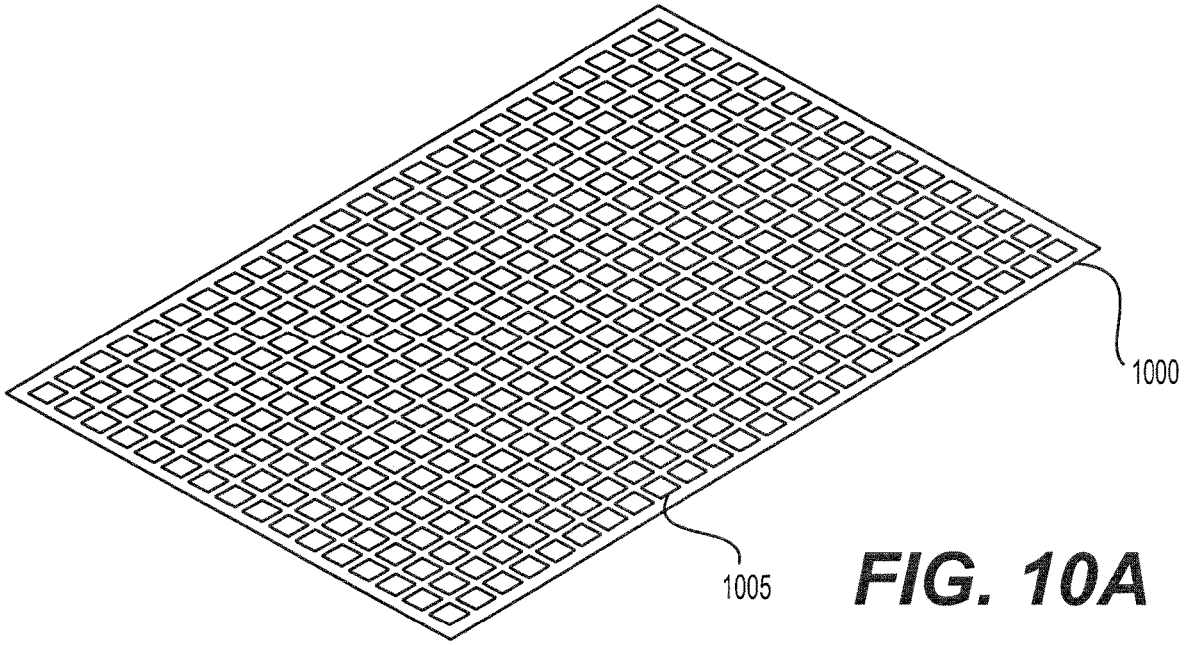
FIG. 10A shows the plurality of driver elements on a panel.

FIG. 10A shows the plurality of driver elements (a single driver element being represented as in 1005) on a panel 1000. The plurality of driver elements can comprise a regular two-dimensional rectangular array covering the plane of the panel with pre-determined center-to-center distances between driver element locations in the x and y directions. The panel can be any shape, for instance, rectangular as shown, or circular, triangular, polygon-shaped, or any other shape. The plurality of driver elements 1005 can be positioned on the panel 1000 in a predetermined arrangement. In one aspect, the predetermined arrangement can include a uniform grid-like pattern on the panel 1000, as shown. For example, rectangular or hexagonal grids are regular arrays where the driver separations are uniform throughout the array, i.e., the array has translational invariance. In certain embodiments, optimized driver placement arrangements have a high degree of symmetry but they do not have translational invariance, i.e., the spacing between drivers is not uniform throughout the array. Possible embodiments include regular arrays, optimized arrays inferred to drive selected panel modes (where these arrays have a high degree of rotational symmetry), or even random arrays.

Moreover, a portion of the plurality of driver elements 1005 can be transparent or substantially transparent to the visible part of the electromagnetic spectrum. Moreover, a portion of the driver elements can be fabricated using a transparent piezoelectric material such as PVDF or other transparent piezoelectric material. In various aspects, the driver elements comprising piezoelectric force actuators can be piezoelectric crystals, or stacks thereof. For example, they can be quartz or ceramics such as Lead Zirconate Titanate (PZT), piezoelectric polymers such as Polyvinylidene Fluoride (PVDF), and/or similar materials. The piezoelectric actuators may operate in both extensional and bending modes. They can furthermore feature transparent electrodes such as Indium Tin Oxide (ITO) or conductive nanoparticle-based inks. The driver elements may be bonded to a transparent panel such as glass, acrylic, or other such materials.

Figure 10B:
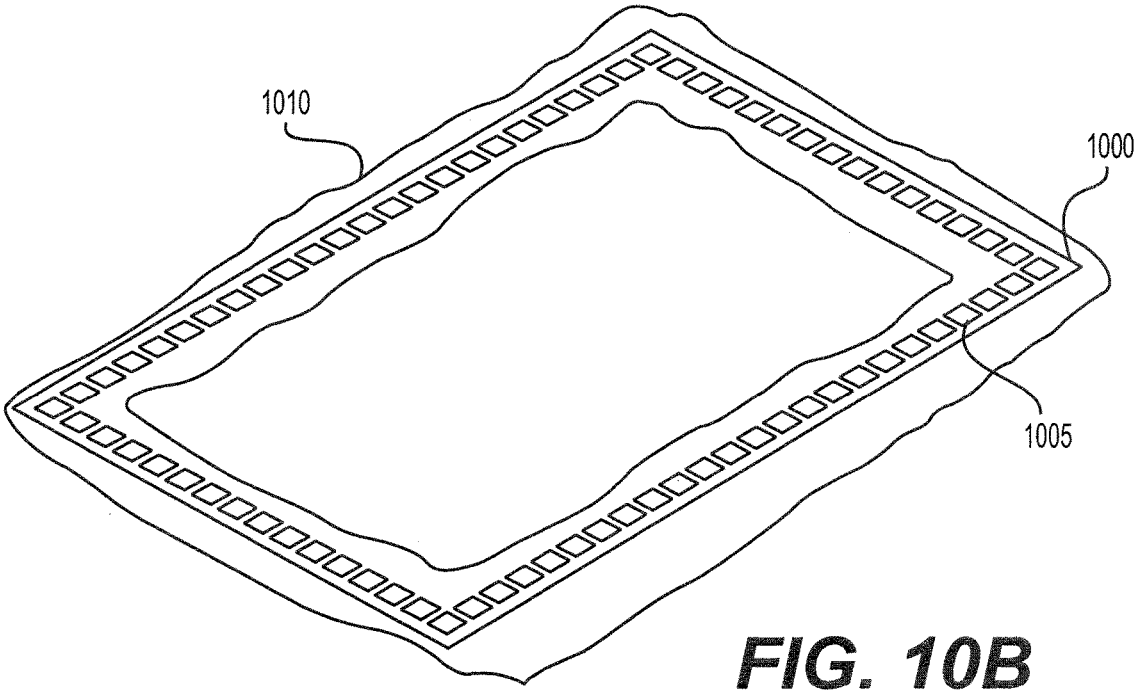
FIG. 10B shows that the driver elements can be arranged around the perimeter of the panel.

In another aspect, FIG. 10B shows that the driver elements 1005 can be arranged around the perimeter 1010 of the panel 1000. The driver elements around the perimeter of the panel 1010 may be uniformly spaced or positioned at Farey fraction locations, which will be discussed later.

A bezel (not shown) can moreover cover a portion of the perimeter of the panel 1010. In that regards, the driver elements 1005 can be positioned underneath the bezel associated with the perimeter of the panel 1010. Such driver elements 1005 positioned underneath the bezel can include a dynamic magnet driver element, a coil driver element, and the like. They, moreover, do not have to be transparent to the visible portion of the electromagnetic spectrum, since they are underneath the bezel.

In one aspect, the piezoelectric material can be polarized so that an electric potential difference applied across the thickness of the material causes strain in the plane of the material. If the driver elements comprising the piezoelectric actuators are located away from the neutral axis of the composite structure, a bending force component perpendicular to the plate can be generated by the application of a voltage across the thickness of the actuator film. In another configuration, piezoelectric force transducers may be mounted on both sides of the plate either in aligned pairs or in different array layouts.

Figure 11:
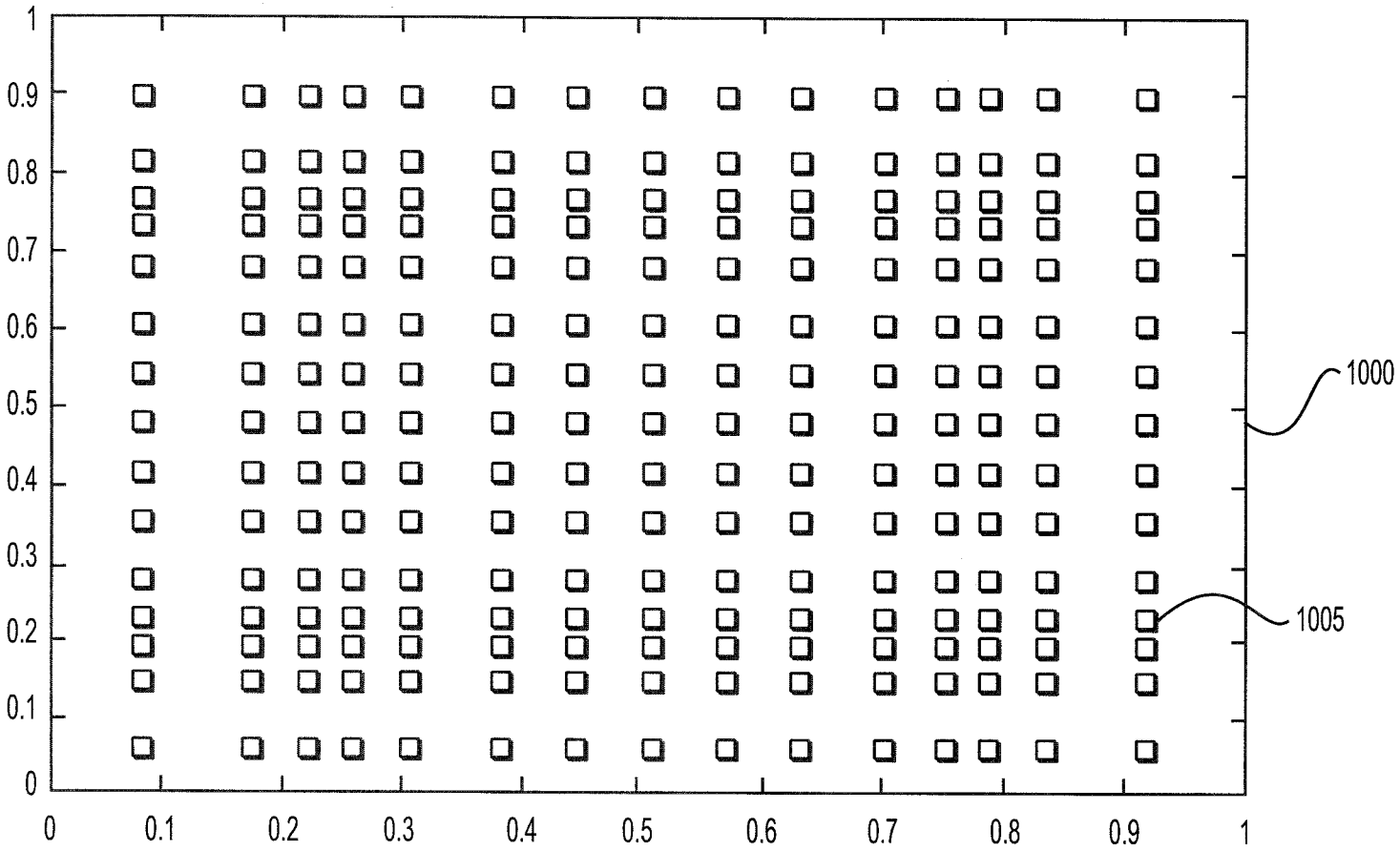
FIG. 11 shows the driver elements being positioned at pre-determined optimized locations on the panel for driving a selected set of pre-determined acoustic modes of the panel.

As shown in FIG. 11, the driver elements (a single driver element being represented in 1005) can be positioned at pre-determined optimized locations on the panel 1000 for driving a pre-determined acoustic mode of the panel 1000. The predetermined optimized locations on the panel for driving a pre-determined acoustic mode of the panel can include a mathematically determined peak of the predetermined acoustic mode. For example, to drive the (1,1) mode of the panel 1000, the driver element 1005 at corresponding to row 05, and column 05 can be driven. While a single driver at any given location will excite several modes simultaneously—for example, using a driver in row 5—column 5 will excite the (1,1) mode but it also will excite the (3,1), (3,3), (5,1) (3,5) and many other modes—it is to be recognized that collective action of several drivers in the array can be chosen to selectively excite a desired mode.

In another aspect, the plurality of driver elements can comprise an array in which the actuators are located at selected anti-nodes of the plate panel vibrational modes. In the case in which the panel is simply supported, the mode shapes are sinusoidal. The actuator locations can then be at the following fractional distances (taking the dimension of the plate to be unity): n/m where m=1, 2, 3, . . . , and n=1, . . . m−1; for example {(½), (⅓, ⅔), (¼, ¾, ¾), (⅕, ⅖, ⅗, ⅘), . . . }. Ratios formed according this rule can be referred to as Farey fractions. Repeated fractions can be removed and any subset of the full sequence can be selected.

Figures 12A, 12B:
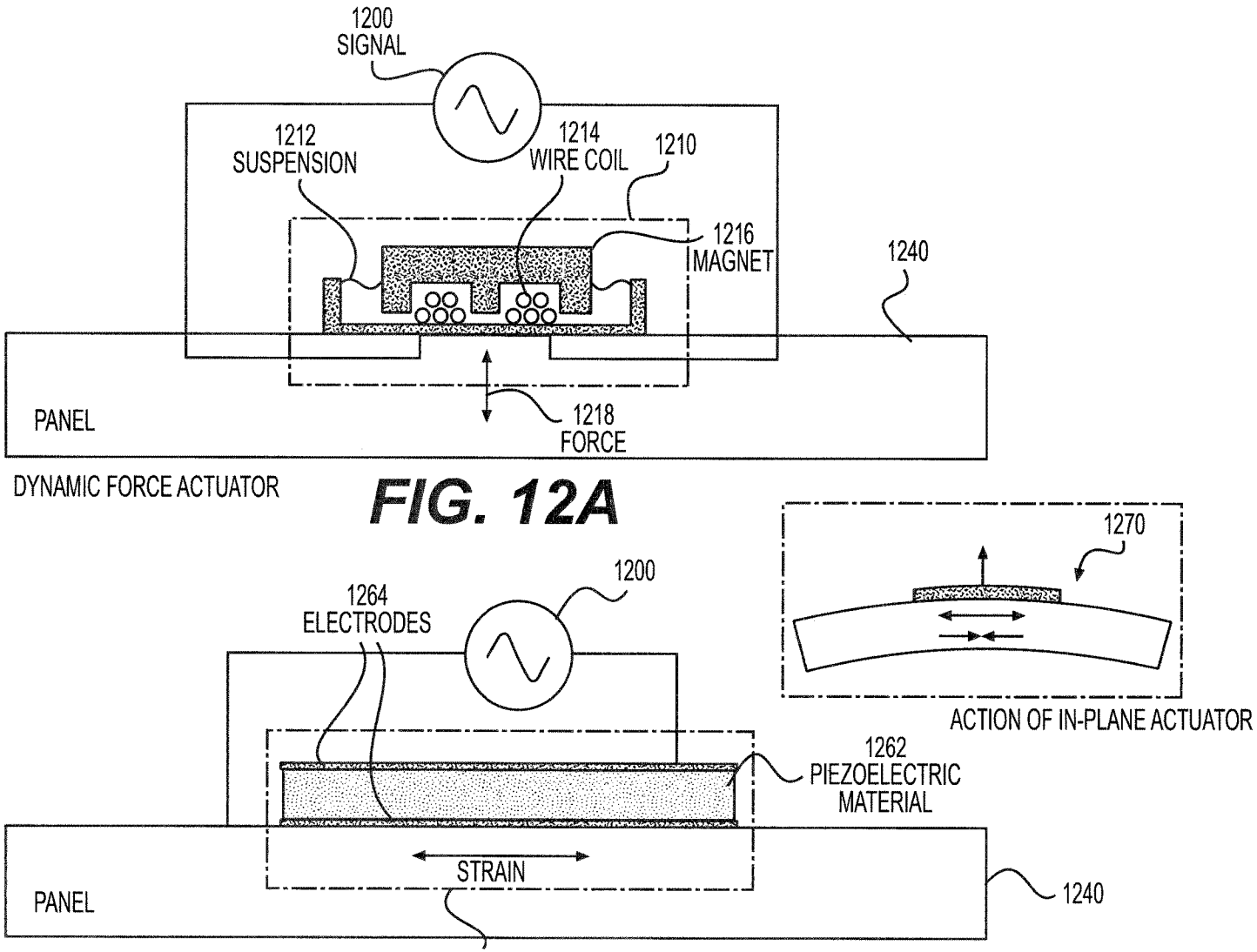
FIGS. 12A and 12B each shows example driver elements. Specifically.

FIGS. 12A and 12B each shows example driver elements. Specifically, FIG. 12A represents a dynamic force actuator. A current produced by a signal source 1200 passes through the dynamic force actuator's 1210 coil 1214 interacting with the magnetic field of a permanent magnet 1216, held by a suspension 1212. This can produce a force 1218 that is perpendicular to the plane of the panel 1240, thereby exciting panel bending vibrations.

FIG. 12B shows an example piezoelectric bending mode actuator 1260 bonded to one surface of a panel 1240. The piezoelectric material 1262 can be polarized so that a voltage 1200 applied by electrodes 1264 across the thin dimension of the element produces strain 1280 (and a force) in the plane of the actuator 1260 (see 1270). If the actuator 1260 is located off of the neutral axis of the composite structure it will exert a component of force perpendicular to the plane of the panel 1240, as shown in the inset (1270), thereby exciting panel bending vibrations.

Figure 13:
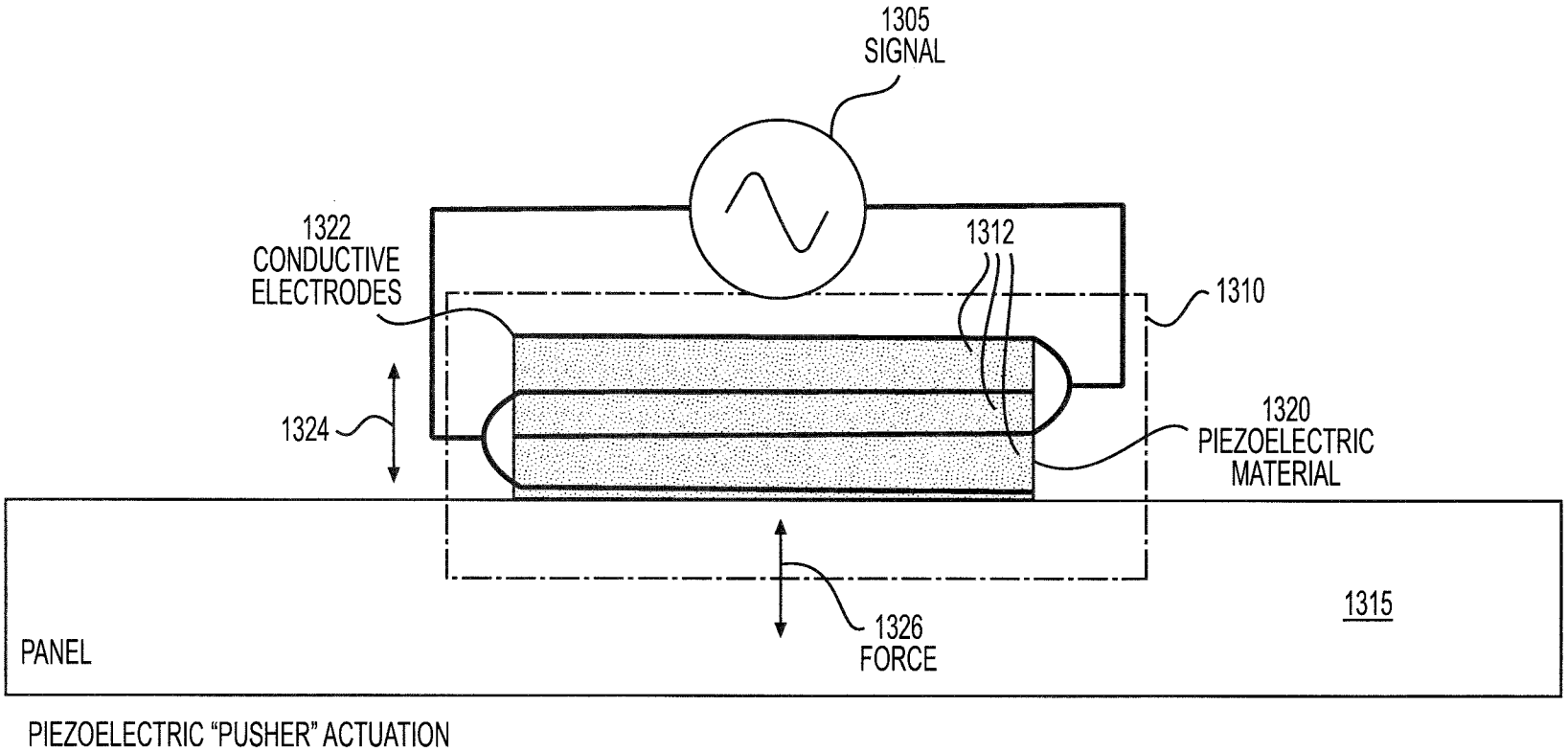
FIG. 13 shows a stacked piezoelectric pusher force actuator.

FIG. 13 shows a stacked piezoelectric pusher force actuator 1310. The stack of piezoelectric elements 1312 are polarized when a voltage 1305 is applied by conductive electrodes 1322 across the thin dimension 1324 of the element to cause a strain. A resulting force generated in the thin dimension 1324 of the elements can be employed to exert a force 1326 that is perpendicular to the plane of the panel 1315. The stack of elements 1312 is mechanically in series but electrically in parallel, thereby amplifying the amount of strain and force produced the actuator 1310.

Figure 14A:
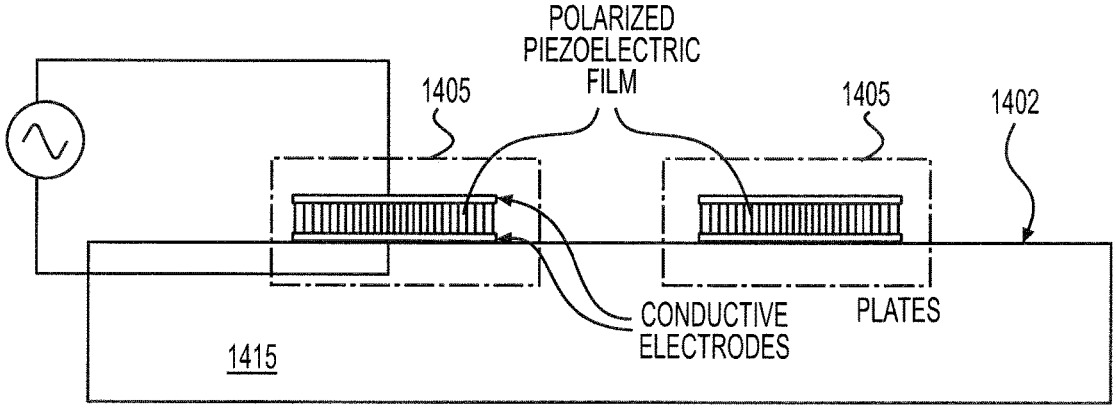
FIG. 14A shows an example array of individual piezoelectric actuators bonded to the surface of a plate.
Figure 14B:
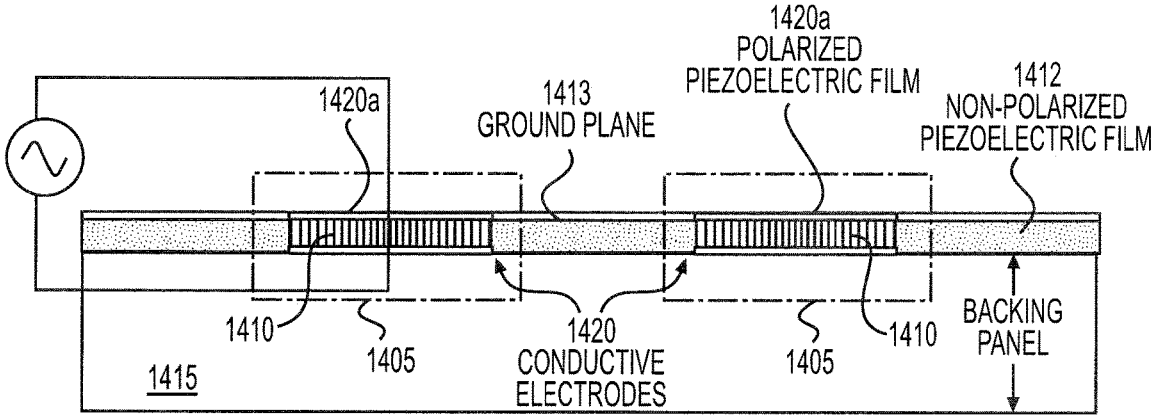
FIG. 14B shows an example configuration for an array of piezoelectric force actuators bonded to a plate.

FIG. 14A shows an array of individual piezoelectric actuators 1405 bonded to the surface 1402 of a plate 1415. FIG. 14B shows a configuration for an array of piezoelectric force actuators 1405 bonded to a plate 1415. In some embodiments, an array of electrodes (e.g., 1420) is formed on the surface of a plate 1415. The sheet of piezoelectric material (e.g., 1412) is then formed on the plate 1415 (e.g., over the electrodes 1420) and a top electrode (shown as 1420*a*) is then deposited to the outer surface of the film 1412. The piezoelectric material (e.g., 1412) is then "poled" (see 1410) to make regions of the film where the electrodes are located piezoelectrically active. The remaining sections of film are left in place (e.g., 1412).

In other embodiments, the array of electrodes (e.g., 1420) is formed on one side of a sheet of non-polarized piezoelectric material (e.g., 1412) prior to it being bonded to the plate 1415. The top electrode (shown as 1420*a*) is then deposited to the outer surface of the film 1412. The piezoelectric material (e.g., 1412) is then "poled" (see 1410) to make regions of the film where the electrodes are located piezoelectrically active, and the sheet of piezoelectric material (e.g., 1412) is then bonded on the plate 1415.

In yet other embodiments, the electrodes (e.g., 1420*a* and 1420) are formed on both side of the sheet of non-polarized piezoelectric material (e.g., 1412) prior to it being bonded to the plate 1415. The piezoelectric material (e.g., 1412) is then "poled" (see 1410) to make regions of the film where the electrodes are located piezoelectrically active, and the sheet of partially-polarized piezoelectric material (e.g., 1412) is then bonded on the plate 1415.

Figure 14C:
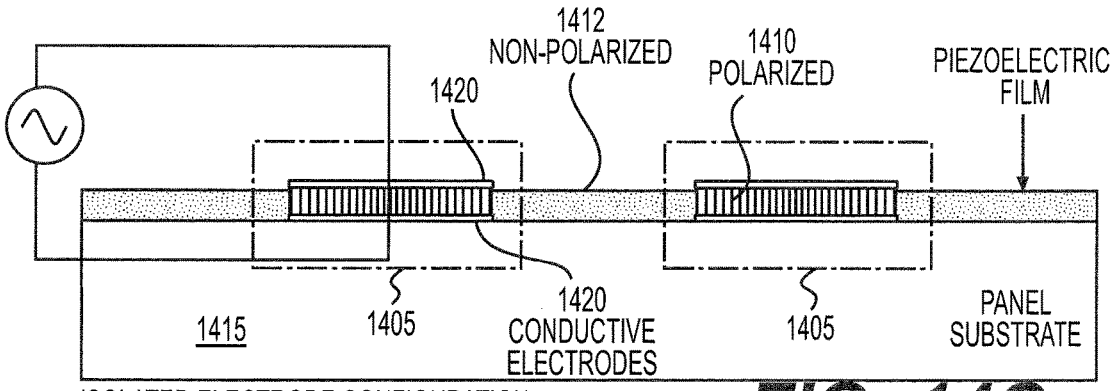
FIG. 14C shows an example configuration of piezoelectric actuators similar to that in FIG. 14B but for which each element has its own separate pair of electrodes.

FIG. 14C shows a configuration of piezoelectric actuators 1405 similar to that in FIG. 14B but for which each element has its own separate pair of electrodes 1420, i.e., the elements do not share a common ground plane (see FIG. 14B, 1413). This isolated electrode configuration allows greater flexibility in the application of voltages to individual elements In various aspects, the driver elements comprising piezoelectric force actuators can be piezoelectric crystals, or stacks thereof. For example, they can include quartz, ceramics such as Lead Zirconate Titanate (PZT), lanthanum doped PZT (PLZT), piezoelectric polymers such as Polyvinylidene Fluoride (PVDF), or similar materials. The piezoelectric force actuators may operate in both extensional and bending modes.

Figure 15:
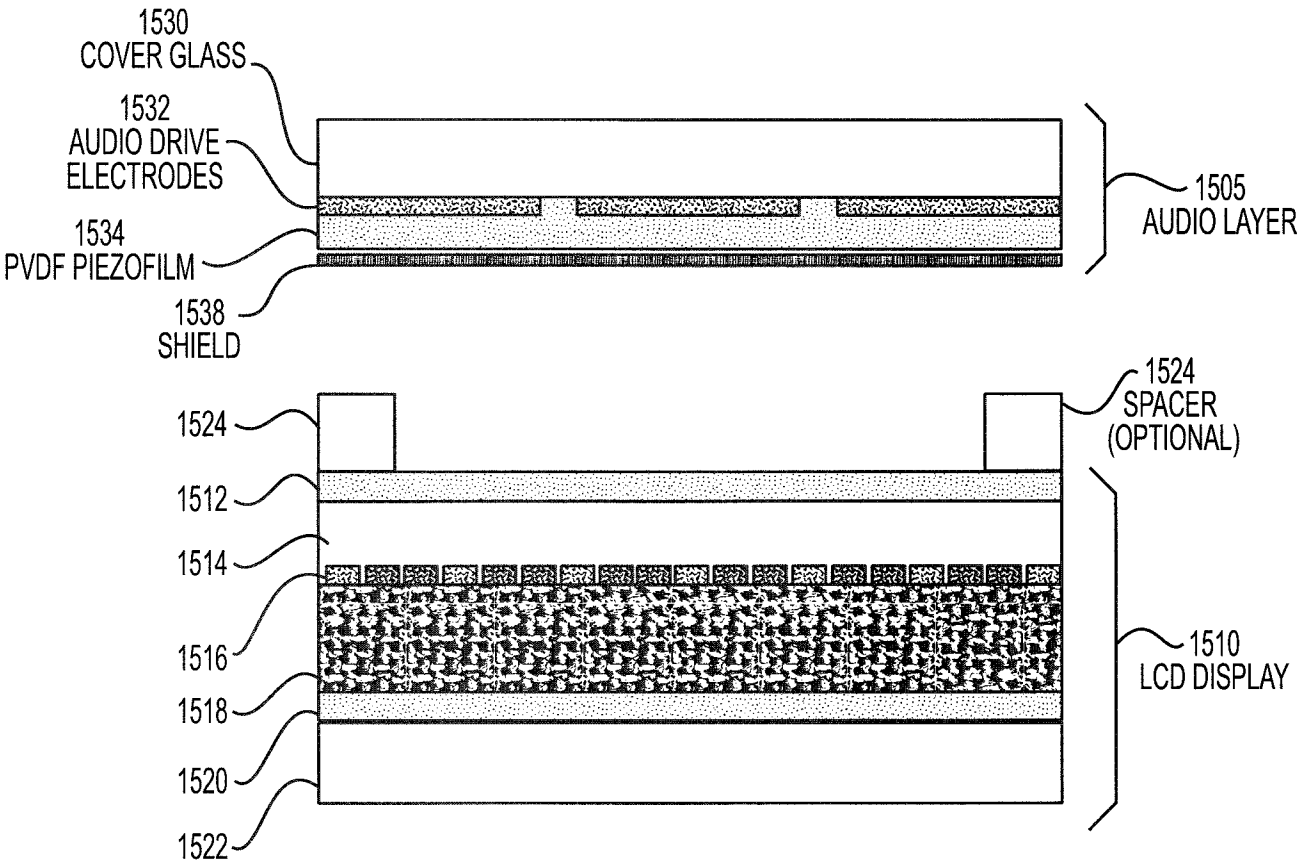
FIG. 15 shows an example integration of an audio layer with a liquid crystal display (LCD).

FIG. 15 shows the integration of an audio layer 1505 with an LCD display 1510. In this configuration a cover glass layer 1530 can serve as the outermost surface of the audio layer 1505. The cover glass 1530 can provide protection to the audio layer 1505 against detrimental environmental factors such as moisture. A piezoelectric film 1534 (such as polyvinylidene fluoride, PVDF, or other transparent material) can be bonded to the inside of the glass layer 1530. Drive electrodes 1532 can be deposited on both sides of the piezoelectric film 1534. The assembly can be positioned atop an LCD display or other type of display 1510. Spacers 1524 may be employed to provide a stand-off distance between the audio layer and the display. This can allow the vibrations of the audio layer 1505 as it produces sound to not vibrate the display 1510.

The LCD display 1510 can include some or all of the following layers: a protective cover 1512 of glass or a polymer material, a polarizer 1514, a color filter array 1516, liquid crystal 1518, thin-film transistor backplane 1520, and back-light plane 1522. Optional spacers, 1524, may be used to support the audio layer on top of the LCD display layer.

In an aspect, the display 1510 can comprise a light-emitting diode (LED), organic light emitting diode (OLED), and/or a plasma display. In another aspect, the audio layer can be laminated onto the LCD display using standard lamination techniques that are compatible with the temperature and operational parameters of the audio layer 1505 and display 1510. The layers of the audio layer can be deposited by standard techniques such as thermal evaporation, physical vapor deposition, epitaxy, and the like. The audio layer 1505 can alternatively be positioned below the display 1510. The audio layer 1505 can moreover be positioned over a portion of the display 1510, for example, around the perimeter of the display 1510.

In various aspects, the audio layer 1505 can moreover be overlain on a display such as a smart phone, tablet computer, computer monitor, or a large screen display, so that the view of the display is substantially unobstructed.

Figure 16:
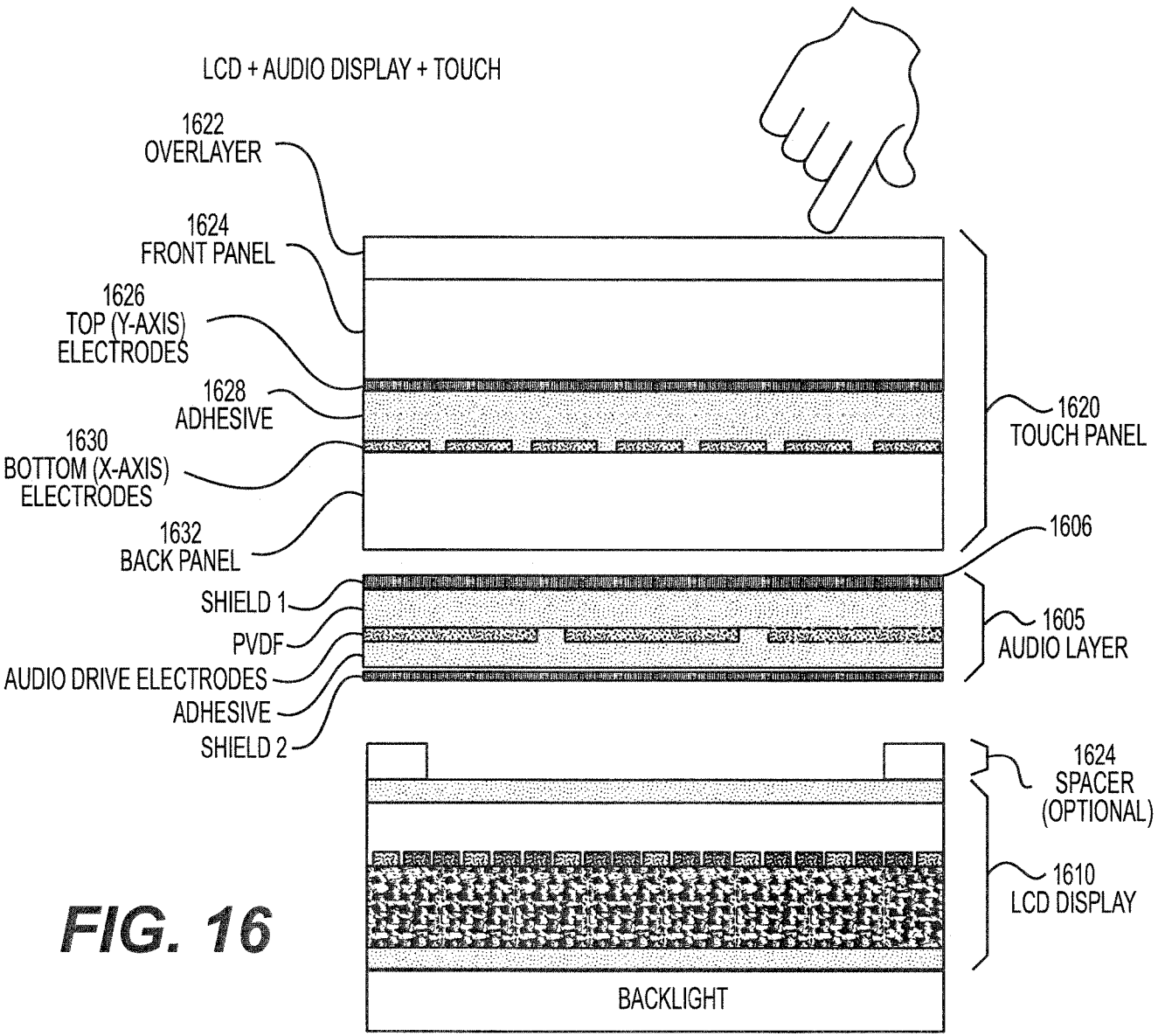
FIG. 16 shows an example audio layer integrated into a touch interface enabled display that comprises a display and a touch panel.

FIG. 16 shows an audio layer 1605 (e.g., as discussed in relation to audio layer 1505 in FIG. 15) integrated into a touch interface enabled display that comprises a display 1610 and a touch panel 1620. The audio layer can be sandwiched between the display 1610 (e.g., as discussed in relation to display 1510 in FIG. 15) and the touch panel 1620. Spacers (e.g., similar to 1624) can be positioned between the audio layer and the display layer, and/or between the audio layer and the touch panel (not shown). Also note that a backing surface (alternatively called a back panel) 1632 is not required in the audio layer 1605 with the bottom layer of the touch panel (1632) serving that purpose. Also note that a second ground plane 1606 can be included in the audio layer 1605 to shield the touch panel 1620 capacitive electrodes (1626 and 1630) from the high voltages employed in the force actuator in the audio layer 1605.

The touch panel can include an over layer 1622 that provides protection against detrimental environmental factors such as moisture. It can further include a front panel 1524 that contributes to the structural integrity for the touch panel. The touch panel can include top and bottom electrodes (in a 2-dimensional array) 1626 and 1630 separated by an adhesive layer 1628. As mentioned, a backing surface (alternatively called a back panel) 1632 can offer further structural rigidity.

In one aspect, the relative positioning of the audio layer 1605, touch panel 1620, and/or the display 1610 can be adjusted (for example, the audio layer 1605 may be positioned below the display 1610) based on preference and/or other manufacturing restrictions.

Figure 17B:
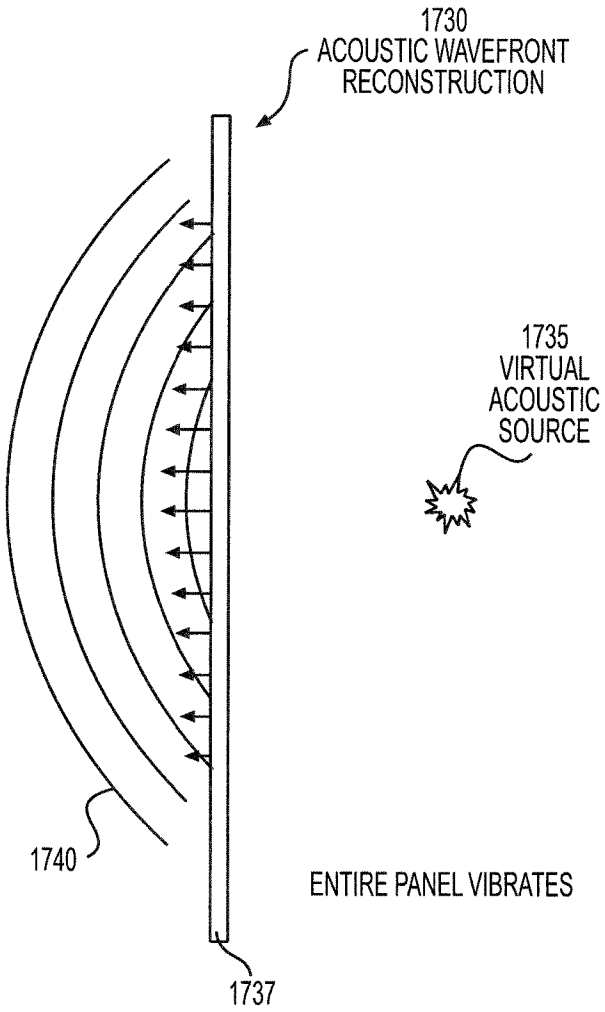
FIG. 17B shows the synthesis of a virtual acoustic source employing wave front reconstruction.
Figure 17A:
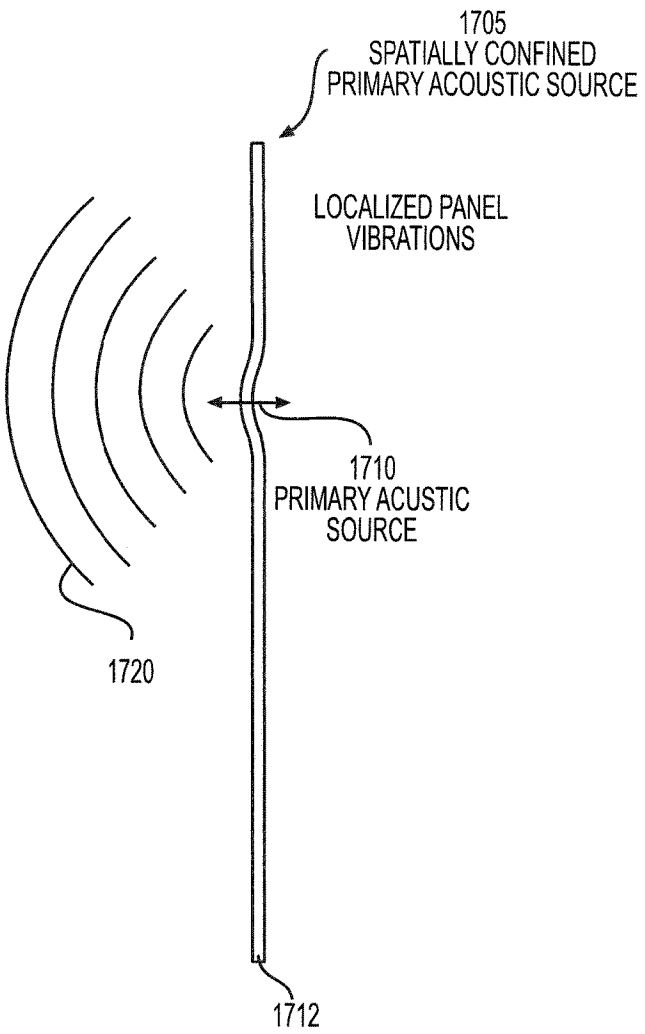
FIG. 17A shows the synthesis of a primary acoustic source by making the panel vibrate in a localized region to radiate sound waves.

FIG. 17A shows the synthesis of a primary acoustic source 1710 by making the panel 1712 vibrate in a localized region to radiate sound waves 1720. In this case, the localized region that is vibrated corresponds to the primary acoustic source 1710. FIG. 17B shows the synthesis of a virtual acoustic source 1735 employing wave-field synthesis source. In the latter case the entire surface of the panel 1737 is driven to vibrate in such a way that it radiates sound waves 1740 distributed to create a virtual source 1735 located at some point behind the plane of the panel 1737.

Figure 18A:
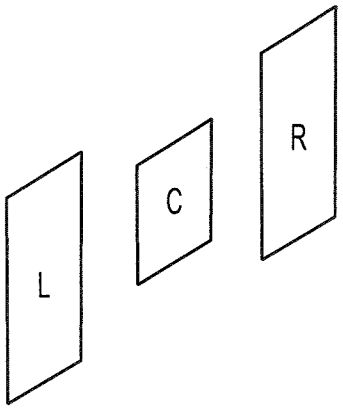
FIGS. 18A, 18B, and 18C show two possible applications of primary acoustic source control. Specifically.
Figure 18B:
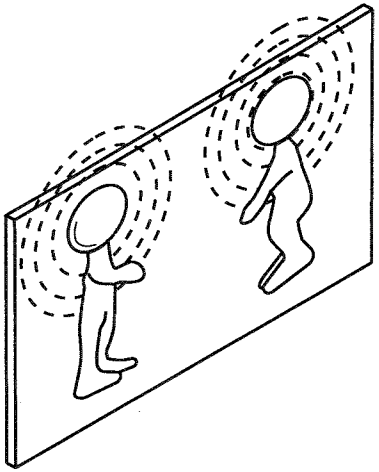
Figure 18C:
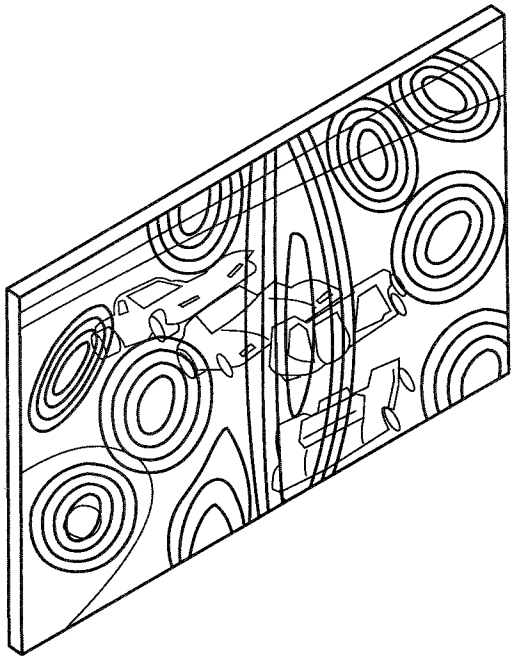

FIG. 18, comprising FIGS. 18A, 18B, and 18C, shows two possible applications of primary acoustic source control. FIG. 18A shows the panel vibrations being controlled to produce the left, right and center channels in a for a surround sound application. FIG. 18B shows the audio sources being bound to a portion of a video or image associated with a display. For example speech audio signals may be bound in this way to the video and/or images of one or more speakers being shown. FIG. 18C shows how the composite wavefronts at the plane of the display from an array of secondary audio sources would be synthesized by the audio display using wave field synthesis to simulate a virtual acoustic source.

Figure 19:
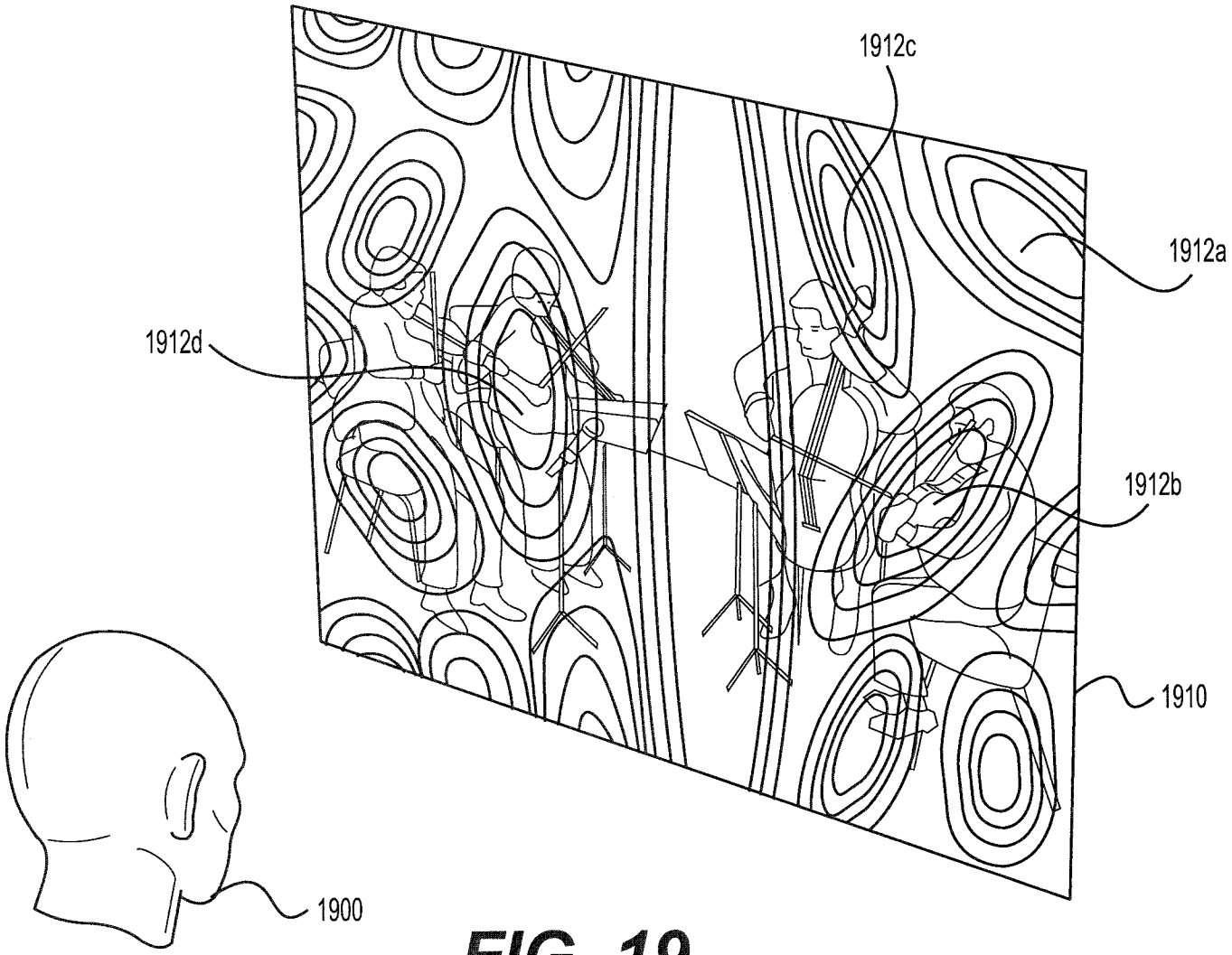
FIG. 19 illustrates wavefront reconstruction in which the combined acoustic wave fronts of multiple acoustic sources are produced at the plane of the audio display.

FIG. 19 illustrates wavefront reconstruction in which the combined acoustic wave fronts of multiple acoustic sources (e.g., 1912*a*, 1912*b*, 1912*c*, 1912*d*, etc.) are produced at the plane of the audio display, 1910, with respect to a viewer 1900. In some embodiments, portions of the generated acoustic sources coincides (i.e., dynamically moves) with the displayed imagery and other portions of the generated acoustic source are fixed with respect with the viewed imagery.

Example—Audio Display for Video Projection System

Figure 20:
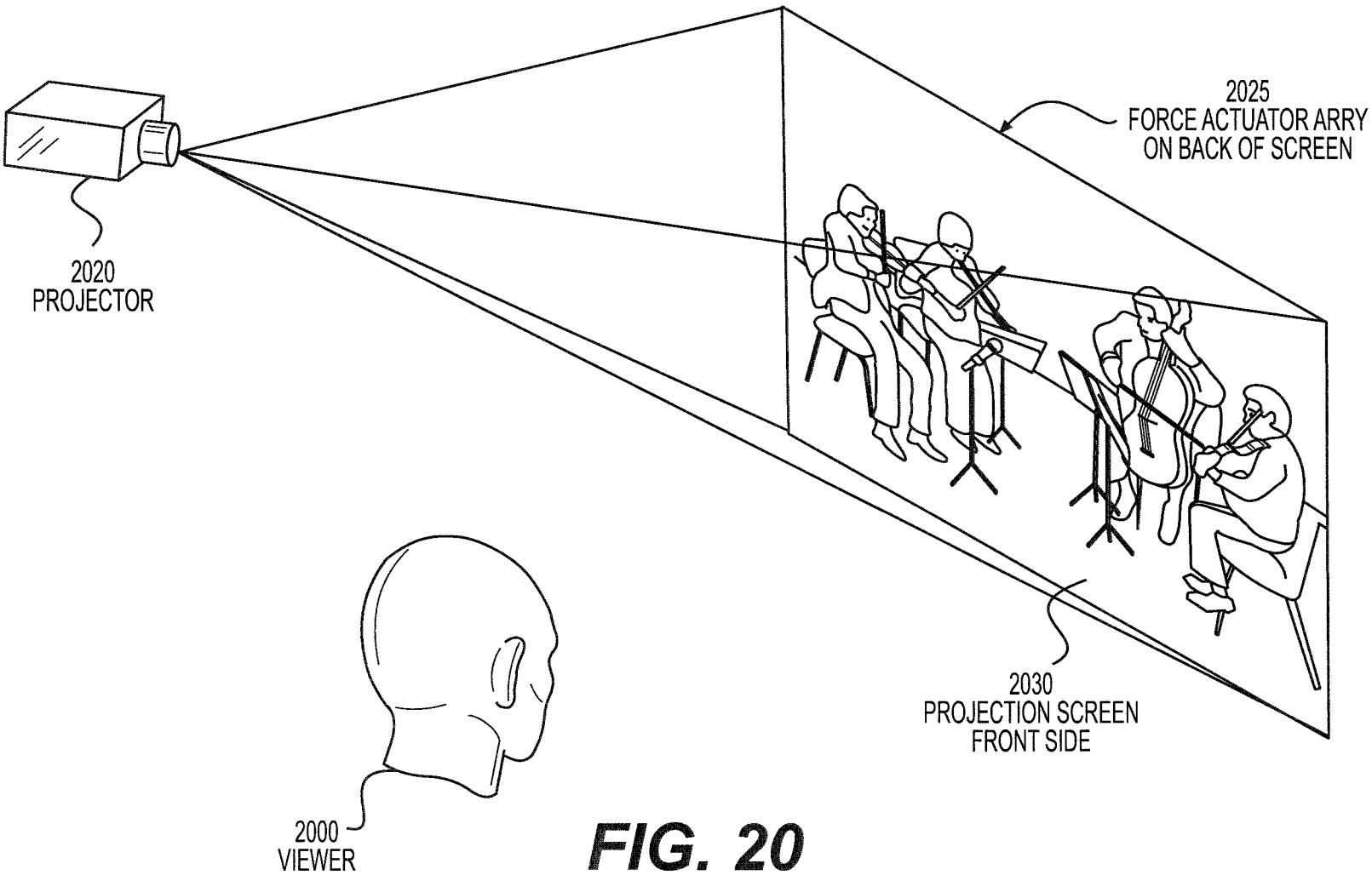
FIG. 20 shows an implementation of an example audio display for a video projection system. An array of force actuators are attached to the back of the reflective screen onto which images are projected.

FIG. 20 shows an implementation of an audio display for a video projection system with respect to a viewer 2000. An array of force actuators 2025 are attached to the back of the reflective screen 2030 onto which images are projected via a projector 2020.

Figure 21:
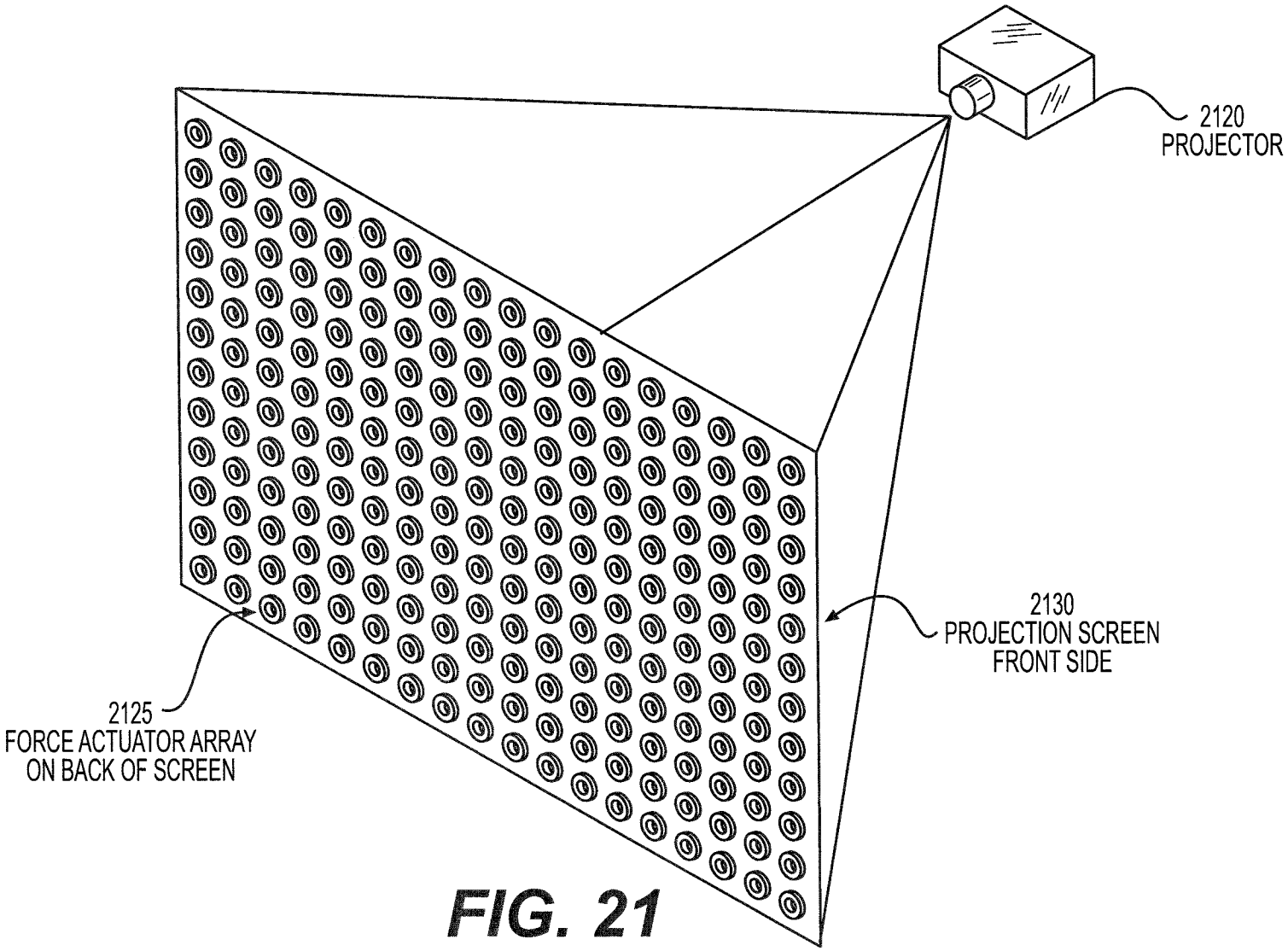
FIG. 21 is a view of an example projection audio display from the back side showing the array of force actuators.

FIG. 21 is a view of a projection audio display from the back side showing the array of force actuators 2125, the front side of the projection screen 2130, and the projector 2120.

Example—Phase Array Sound Synthesis

Figure 22:
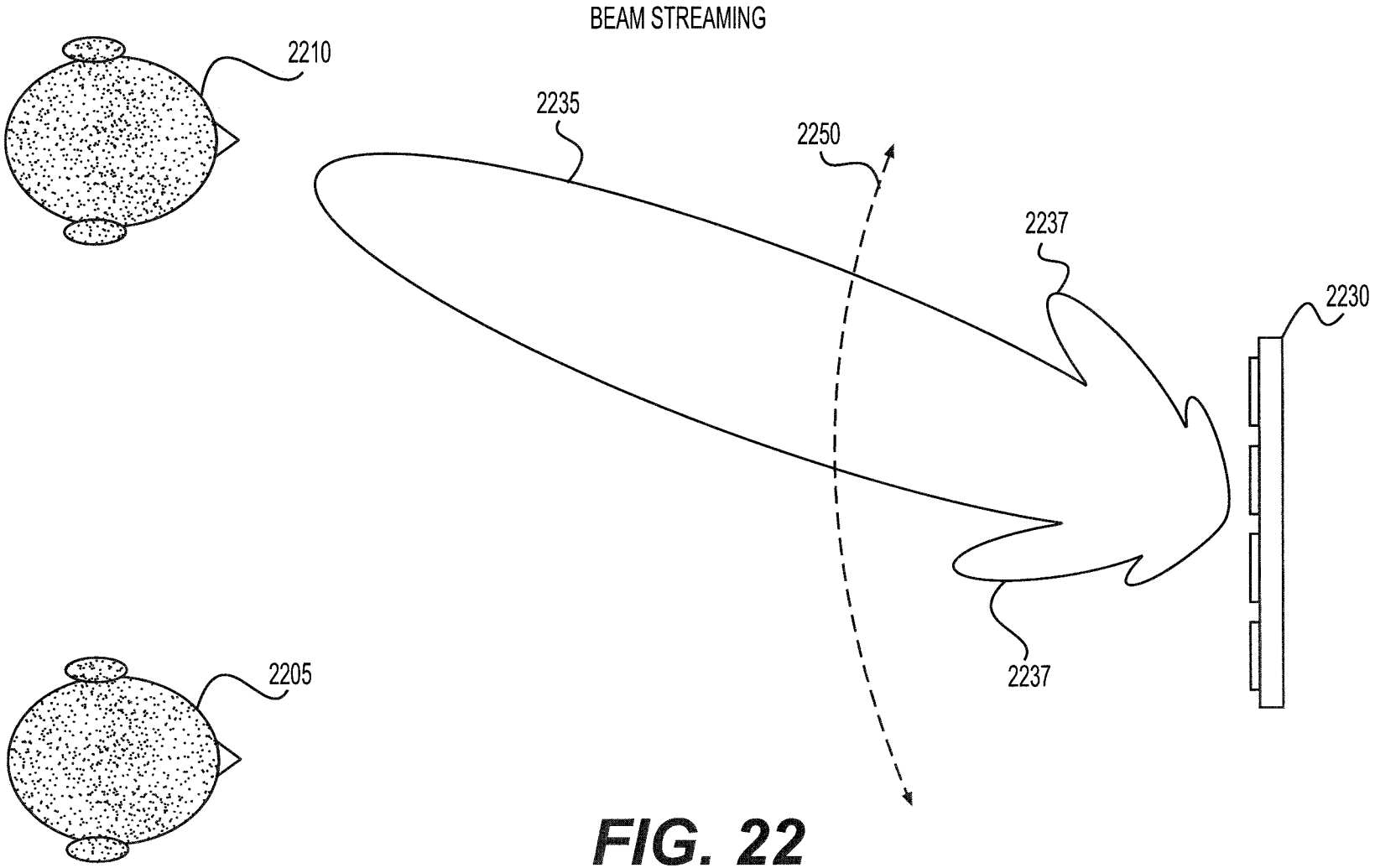
FIG. 22 is an illustration of beam steering in a phased array sound synthesis scheme.

FIG. 22 is an illustration of beam steering in a phased array sound synthesis scheme. Here, the display including the driver elements 2230 can project a beam of audio, including a main lobe 2235 directed to a given viewer/listener (2210 or 2205). The beam can furthermore be steered (i.e. re-oriented) as represented by 2250. This can be achieved through phased array methods, for example. A series of side lobes 2237 can exist in addition to the main lobe 2235, but can have a reduced amplitude with respect to the main lobe 2235. In this manner, an audio signal can be beamed such that if a receiver is positioned within a predetermined angular range with respect to a vector defining a normal direction to the plane of the panel defined at a predetermined location on the display, the receiver can receive an audio signal having a higher amplitude than a receiver positioned outside the predetermined angular range. Moreover, one or more cameras can be used to track the location of the viewers/listeners (2210 and 2205), and the locations are used by the beam steering technique to direct the audio signal to the viewers/listeners (2210 and 2205).

Figure 23:
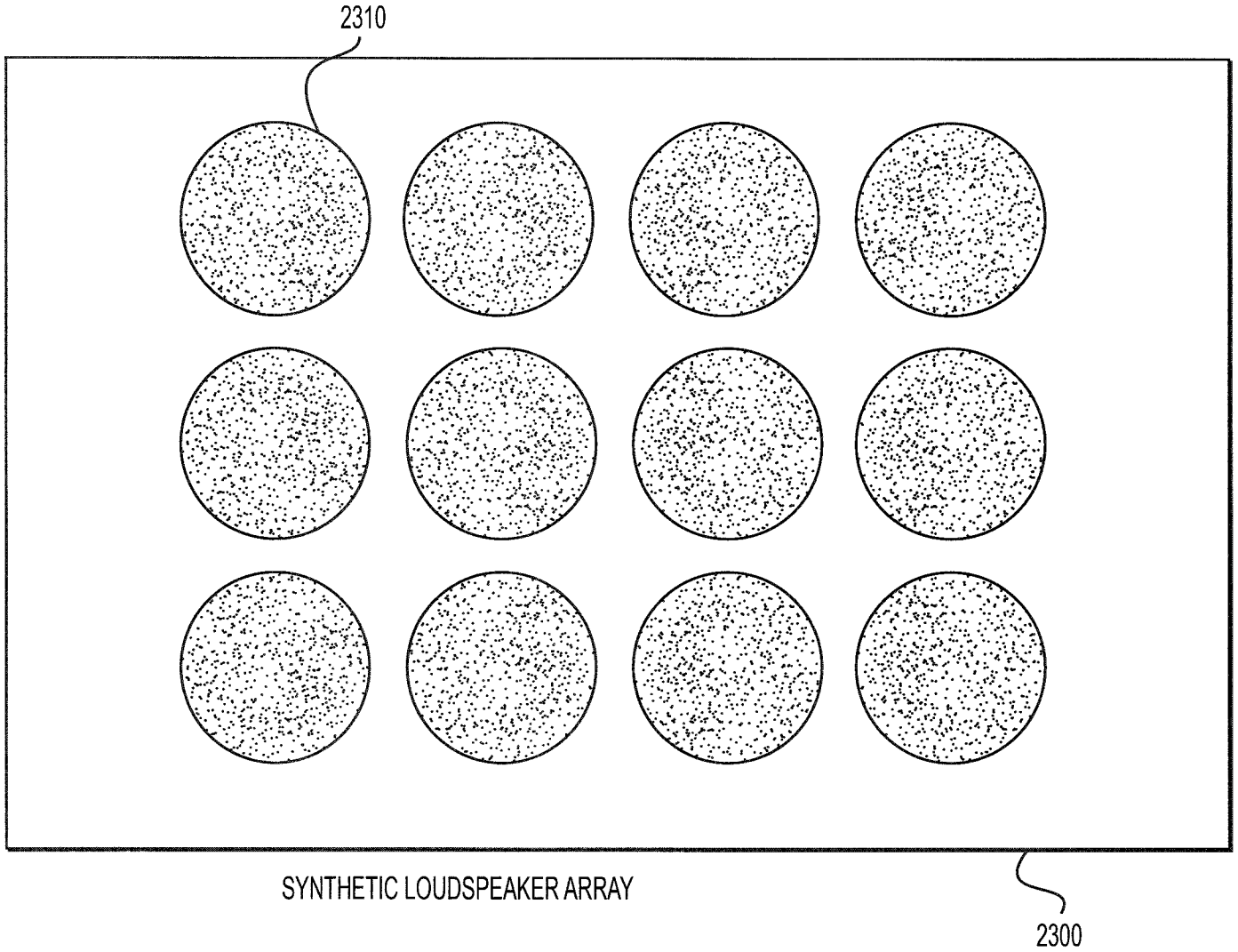
FIG. 23 shows a rectangular array of primary sound sources in the plane of the audio display. Phased array techniques may be employed to direct the acoustic radiation in any selected direction.

FIG. 23 shows a rectangular array of primary sound sources 2310 in the plane of the audio display 2300. The primary sound sources 2310 can comprise many driver elements. Phased array techniques may be employed to direct the acoustic radiation in any selected direction.

Figure 24:
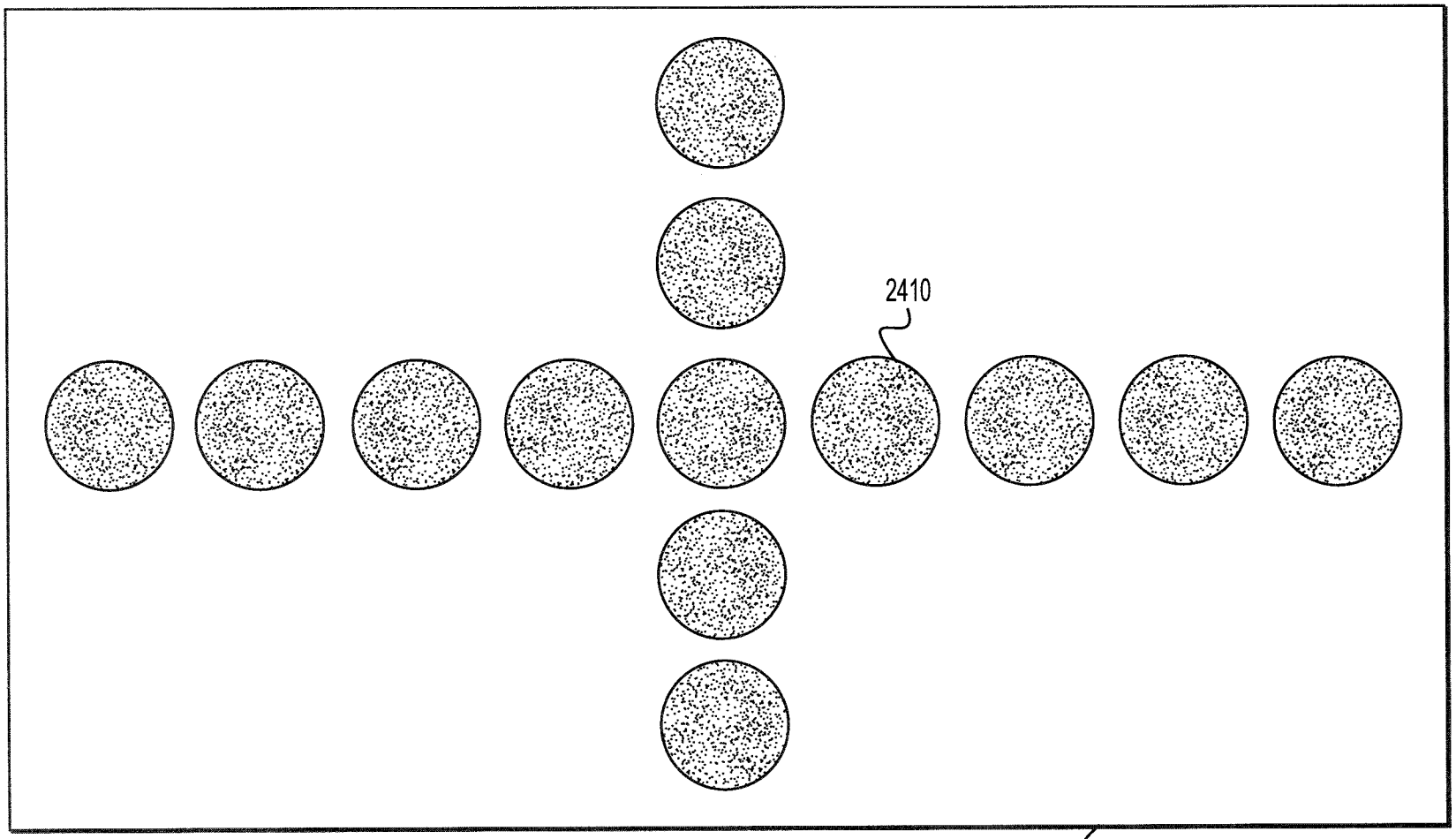
FIG. 24 shows a cross-shaped array of primary sound sources in the plane of the audio display, which can be employed in a phased array sound beaming scheme.

FIG. 24 shows a cross-shaped array of primary sound sources 2410 in the plane of the audio display 2400, which can be employed in a phased array sound beaming scheme. The primary sound sources 2410 can comprise many driver elements.

Figure 25:
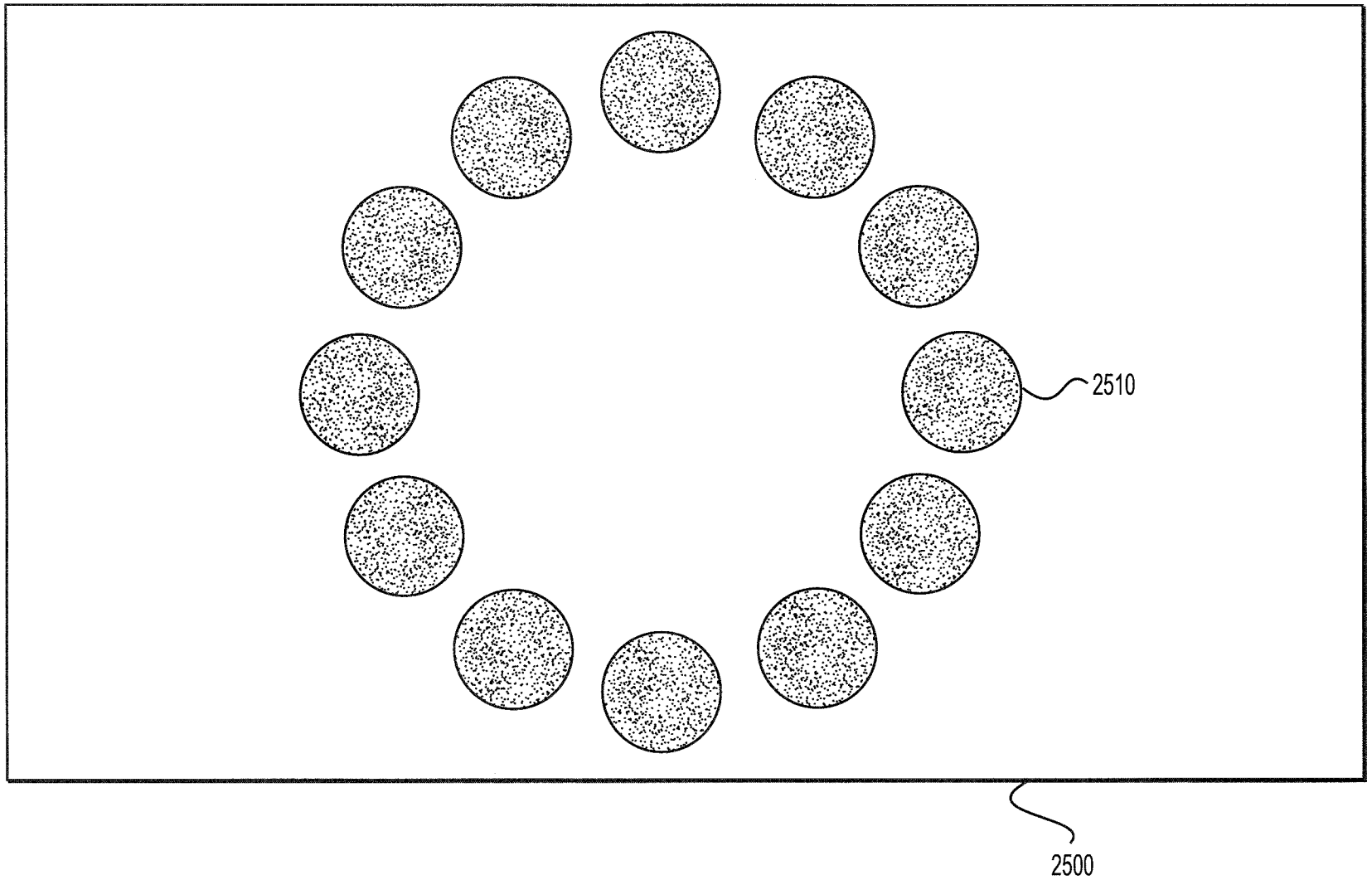
FIG. 25 shows a circular array of primary sound sources in the plane of the audio display with which a phased array sound beaming scheme may be employed.

FIG. 25 shows a circular array of primary sound sources 2510 in the plane of the audio display 2500 with which a phased array sound beaming scheme may be employed. The primary sound sources 2500 can comprise many driver elements.

Example—Audio OLED Display

The continued development of OLED display technology has led to monolithic displays that are very thin (as thin as 1 mm or less) and flexible. This has created the opportunity to employ the display itself as a flat-panel loudspeaker by exciting bending vibrations of the monolithic display via an array of force driving elements mounted to its back. The displays often are not flat, being curved, in some embodiments, to achieve a more immersive cinematic effect. The methods described here will work equally well in such implementations. Actuating the vibrations of a display from its back eliminates the need to develop a transparent overlayer structure to serve as the vibrating, sound emitting element in an audio display. As described above, such structures could be fabricated employing transparent piezoelectric bending actuators using materials such as PLZT (Lanthanum-doped lead zirconate titonate) on glass or PVDF (Polyvinylidene fluoride) on various transparent polymers.

Both voice-coil type actuators (magnet and coil) and piezo-electric actuators, as discussed in relation to FIGS. 12-14, may be mounted to the back of a flexible display to actuate vibrations.

Figure 26:
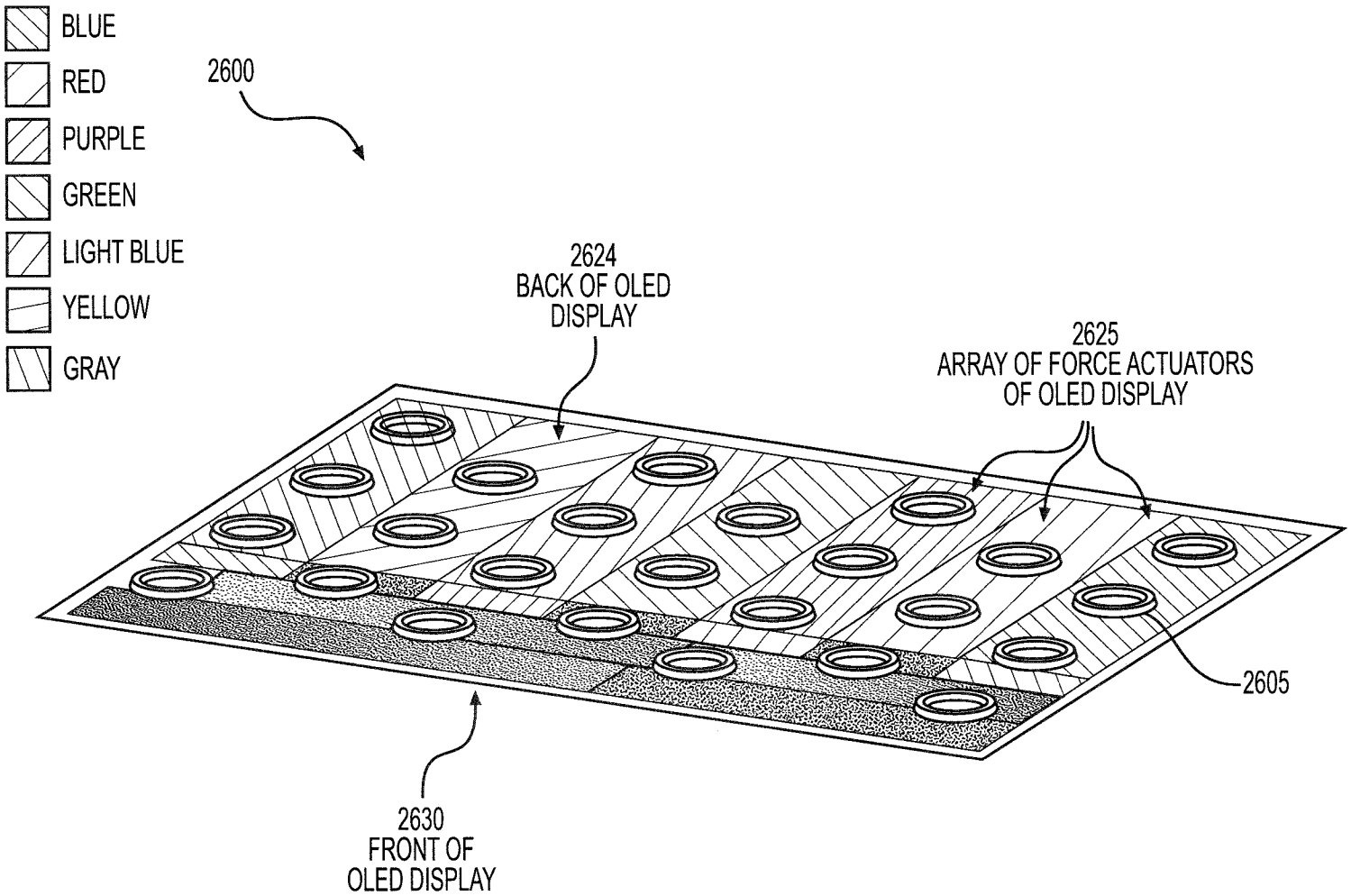
FIG. 26 illustrates an example OLED display with an array of voice-coil actuators attached to the back of the panel.

FIG. 26 illustrates an OLED display 2600 with an array of voice-coil actuators 2625 (e.g., one actuator is shown as 2605) attached to the back of the panel (2624). The number and locations of the actuators can be adjusted to achieve various design goals. A denser array of force actuators enables higher spatial resolution in the control of panel vibrations and the precise actuator locations can be chosen to optimize the electro-mechanical efficiency of the actuator array or various other performance metrics.

Figure 27:
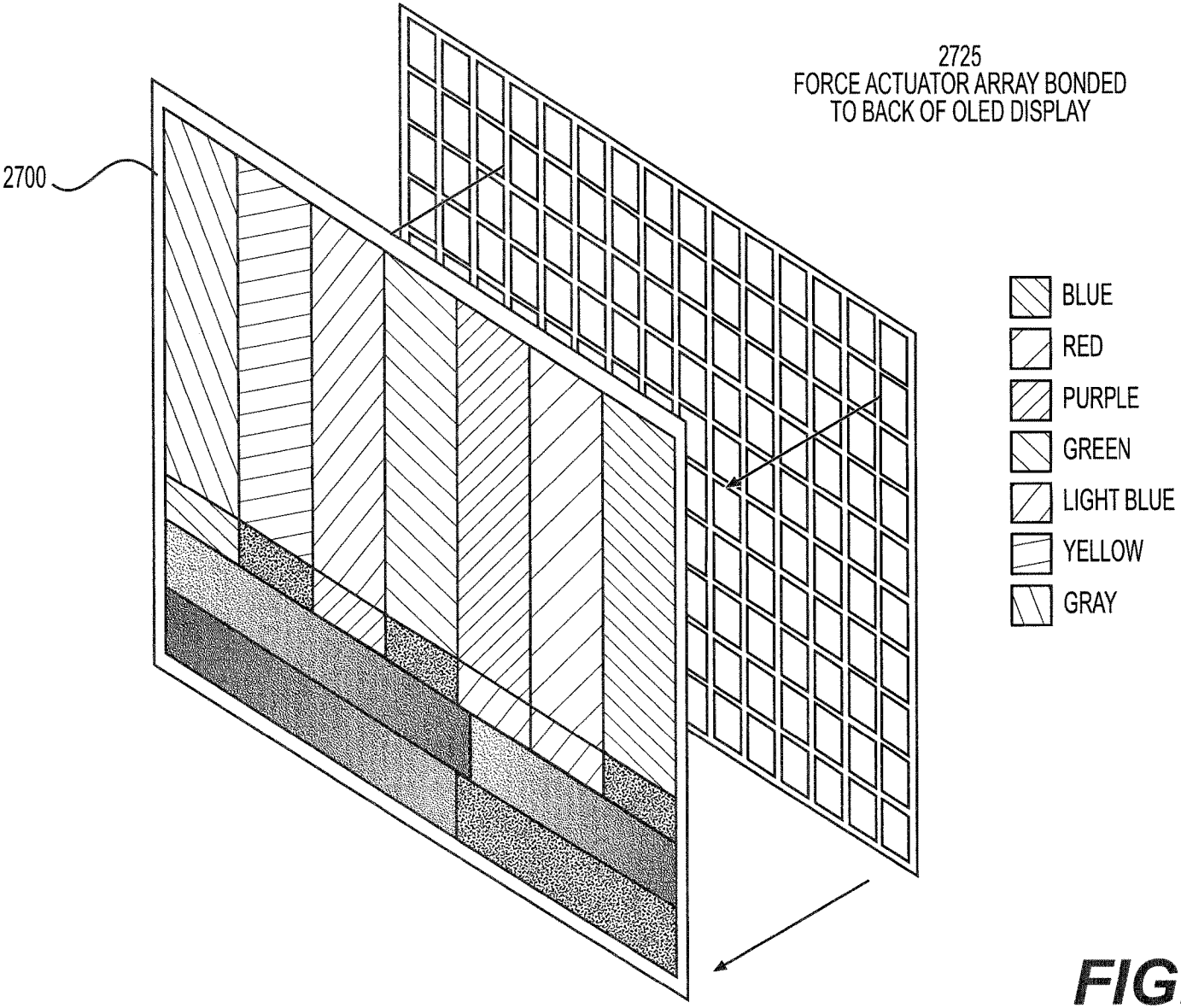
FIG. 27 shows an example array of piezoelectric force actuators mounted to the back of an OLED display.

FIG. 27 shows an array of piezoelectric force actuators 2725 mounted to the back of an OLED display 2700. The actuators would operate, in some embodiments, in their bending mode in which a voltage applied across the thin dimension of the piezoelectric material causes it to expand or contract in plane. As shown, the actuator array 2725 may be formed on a substrate that can be bonded to the back of the OLED display 2700. In some embodiments, an interposing layer is placed between the back of the OLED display 2700 and the formed substrate of the actuator array 2725. In some embodiments, it is important to match the Young's modulus of the piezoelectric material to the OLED backplane substrate material and/or the interposing layer. For example, for OLED's fabricated on a glass backplane, it may be advantageous to employ a glass, ceramic, or similar material as the force actuator substrate and employ a piezoelectric actuator material such as PZT (lead zirconate titanate) or similar "hard" piezoelectric material. For OLEDs with a backplane fabricated on polyimide or other "soft" polymer material, a soft piezoelectric material (with a low Young's modulus) such as the polymer PVDF (polyvinylidene fluoride), and the like, may be used. A piezo substrate material with a similar Young's modulus can also be employed.

Figure 28B:
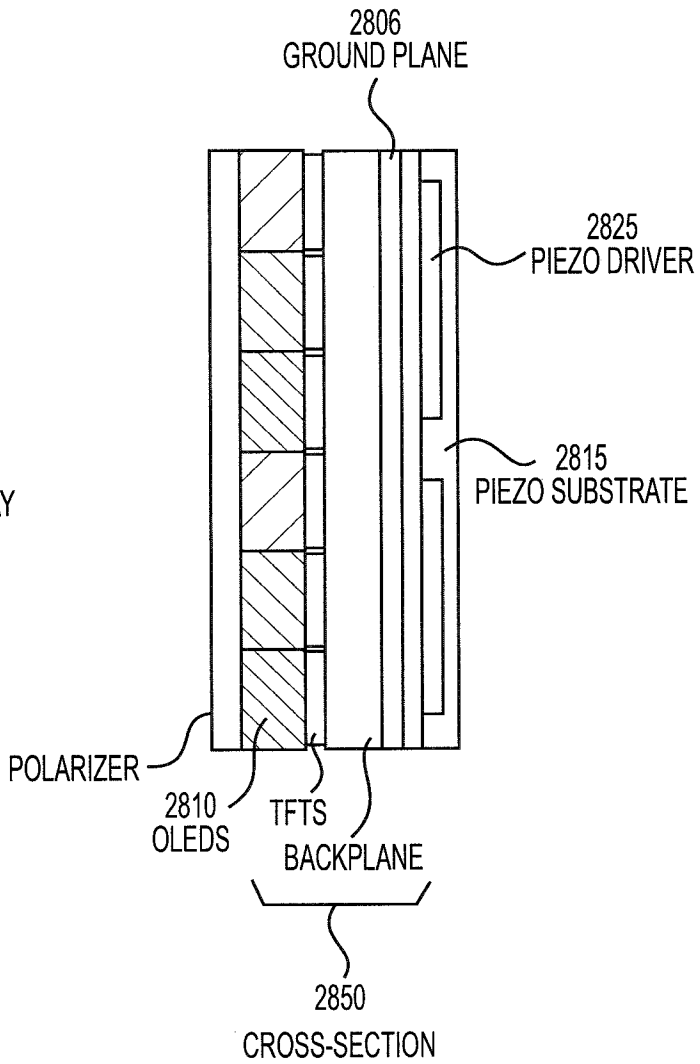
FIGS. 28A and 28B, shows an expanded view of an example monolithic OLED Display with piezo driver array.
Figure 28A:
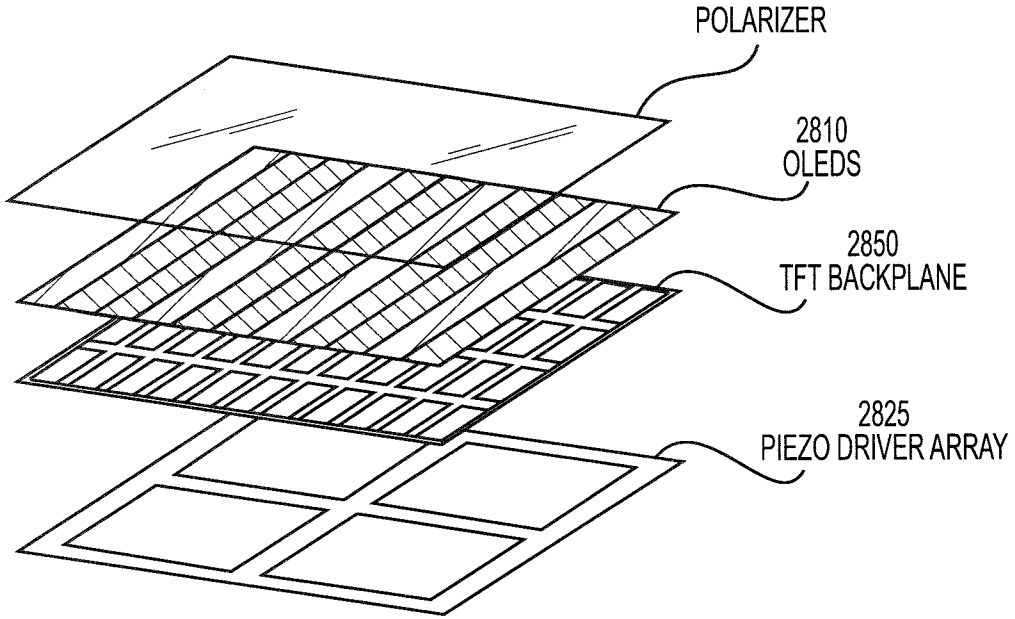

FIGS. 28A and 28B each shows an expanded view of a monolithic OLED Display with piezo driver array 2825 (e.g., as for example discussed in relation to array 2625 and 2725 in FIGS. 26 and 27). As shown in FIGS. 28A and 28B, the piezo-driver array 2825 in the form of a polymer sheet could be bonded to the back of the OLED display (shown comprising a TFT backplane 2850). In some embodiments, an interposing layer is placed between the back of the OLED display and the polymer sheet. FIG. 28B shows a cross section of the monolithic structure including the piezoelectric actuator patches 2825 fabricated on a substrate material 2815 with a ground plane 2806 on the actuator sheet 2825 to isolate the OLED thin film transistors 2810 from the electric fields required to energize the piezoelectric actuators (e.g., 2825).

Audio-Source Rendering on Flat-Panel Loudspeakers with Non-Uniform Boundary Conditions Devices from smartphones to televisions are beginning to employ dual purpose displays, where the display serves as both a video screen and a loudspeaker. Described herein is a method to generate localized sound-radiating regions on a flat panel that may be aligned with corresponding image features. An array of force actuators is affixed to the back of a panel. The response of the panel to each actuator is initially measured via a laser vibrometer, and the required actuator filters for each source position are determined by an optimization procedure that minimizes the mean squared error (MSE) between the reconstructed and targeted acceleration profiles. The array pf actuators is driven by appropriately filtered audio signals so the combined response of the actuator array approximates a target spatial acceleration profile on the panel surface. Since the single-actuator panel responses are determined empirically, the method does not require analytical or numerical models of the system's modal response, and thus is well-suited to panels having the complex boundary conditions typical of television screens, mobile devices, and tablets.

The method is demonstrated on two panels with differing boundary conditions. When integrated with display technology, the localized audio source rendering method may transform traditional displays into multimodal audio-visual interfaces by colocating localized audio sources and objects in the video stream.

Theory for Method for Localizing Sound-Sources to Specific Vibrating Regions of a Panel In this analysis, the moving coil actuators are assumed to approximate point forces on the panel. Let a panel of surface area S, thickness h, and density p have a complex spatial acceleration response $\tilde{\varphi}_i(x, y, \omega)$ when a complex excitation signal $\tilde{F}e^{j\omega t}$ is applied to an actuator located at position $(x_i; y_i)$.

Following Fuller (C. Fuller, S. Elliott, and P. Nelson, Active Control of Vibration. Associated Press, 1996), each spatial acceleration response is decomposed as a weighted superposition of resonant modes, $$\tilde{\varphi}_i(x, y, \omega) = \sum_{r=1}^{\infty} -\omega^2 \tilde{F} \tilde{\alpha}_{ir} \Phi_r(x, y), \tag{25}$$

where $_r(x, y)$ is the spatial response of each resonant mode, and $\alpha_{ir}$ is the frequency dependent amplitude of each mode. As the boundary conditions of the system are unknown in the analysis, the spatial response of each mode may not be further specified. From Fahy (F. Fahy and P. Gardonio, Sound and Structural Vibration: Radiation, Transmission and Response 2nd Edition. Elsevier, Science, 2007), the amplitude of each mode may be expressed in terms of the actuator location, the resonant frequency of the mode $\omega_r$, and the quality factor of each mode $Q_r$ as, $$\tilde{\alpha}_r - \frac{4\Phi_r(x_i, y_{ui})}{\rho h S(\omega_r^2 - \omega^2 + j\omega_r\omega/Q_r)}. \tag{26}$$

The total response $\tilde{\varphi}(x, y, \omega)$ of a panel excited by an array of N actuators, is given by the superposition of the responses to each actuator individually, $$\tilde{\varphi}(x, y, \omega) = \sum_{i=1}^{N} \tilde{\varphi}_i(x, y, \omega) = \sum_{i=1}^{N} \sum_{r=1}^{\infty} -\omega^2 \tilde{F}\tilde{\alpha}_{ir}\Phi_r(x, y), \tag{27}$$

The modal amplitudes $A_r$ of a specified target spatial acceleration profile $\Psi(x, y)$ may be determined by Fourier series expansion, $$A_r = \frac{4}{S}\int\int_S \Psi(x, y)\Phi_r(x, y)dy\ dx, \tag{28}$$

From (27), the total response of a panel excited by an array of N actuators may be expressed as a sum of the modal excitations due to each actuator individually. A filter $\tilde{H}_i(\omega)$ with magnitude $|\tilde{H}_i(\omega)|$ and phase $\theta_i$ may be applied to the signal sent to each force actuator so that the weighted sum of the modal amplitudes of the panel's spatial acceleration profile match the modal amplitudes of $\Psi(x, y)$, $$\sum_{i=1}^{N} \tilde{\alpha}_{ir}\left|\tilde{H}_i(\omega)\right|e^{j\theta_i} \approx A_r \tag{29}$$

In reality, a finite number of N actuators can physically be employed on the panel surface. This means that the reconstruction of $\Psi(x, y)$ given in (29) is spatially band-limited to N modes, and thus, some reconstructed mode amplitudes are an approximation of $A_r$.

Combining (27) and (29) gives the spatial response of the reconstructed acceleration profile.

$$\tilde{\varphi}(x, y, \omega) = \sum_{i=1}^{N} \sum_{r=1}^{\infty} -\omega^2 \tilde{F}\tilde{\alpha}_{ir}\left|\tilde{H}_i(\omega)\right|e^{j\theta_i}\Phi_r(x, y) = \sum_{i=1}^{N} \tilde{\varphi}_i(x, y, \omega)\left|\tilde{H}_i(\omega)\right|e^{j\theta_i} \tag{30}$$

The filters for each actuator $\tilde{H}_i(\omega)$ are determined so that the MSE between the acceleration response magnitudes $|\tilde{\varphi}(x, y, \omega)|$ and $\Psi(x, y)$ is minimized for all frequencies. Each spatial response was discretized into M subregions, each with area $\Delta x\Delta y$. The MSE is given by, $$MSE = \frac{1}{M}\sum_{m=1}^{M} [|\tilde{\varphi}(x_m, y_m, \omega)| - \Psi(x_m, y_m)]^2 \tag{31}$$

where $\tilde{\varphi}(x_m, y_m, \omega)$ and $\Psi(x_m, y_m)$ are the accelerations of each response at the center of subregion m.

This approach does not merely infer information about a sound source from a measured acoustic response, instead, a specified vibration response is determined from a set of measured vibration responses. This allows for easy integration of visual/audio image pairing by directly controlling the vibrating surface itself. The reconstructed vibration response remains localized to a particular region of the panel where the in-phase motion of the vibrating region was shown to have uniform radiation properties below the spatial Nyquist frequency of the actuator array.

The present application is further illustrated by the following examples that should not be construed as limiting. The contents of all references, patents, and published patent applications cited throughout this application, as well as the Figures and Tables, are incorporated herein by reference.

Examples

The vibration localization method presented discussed above was tested on two small panels with differing material properties and boundary conditions. The panels were made of 1 mm thick aluminum and 3 mm thick acrylic. Optimization of the panel materials and dimensions to maximize acoustic performance will be the subject of a different study. Both panels have dimensions Lx=113 mm, Ly=189 mm, and are excited by eight 3 W Dayton Audio DAEX13CT-8 audio exciters.

Figure 29:
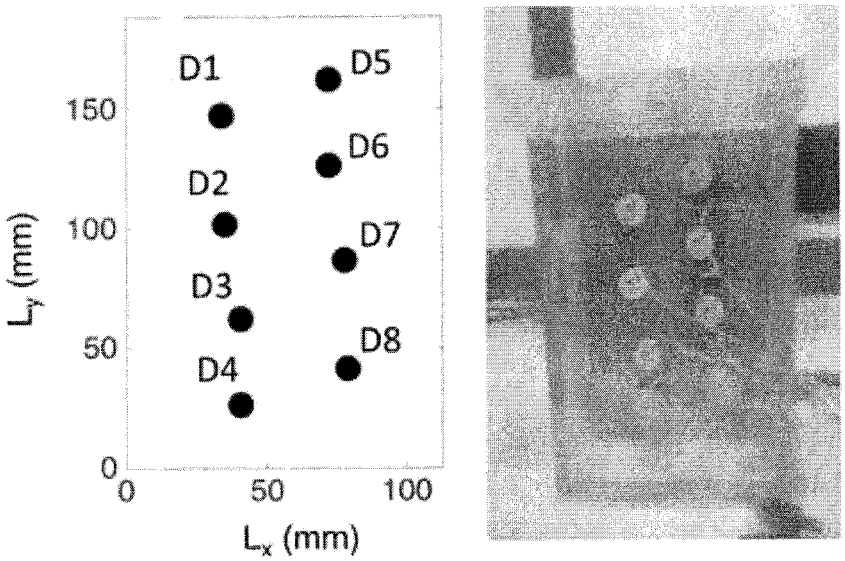
FIG. 29 shows an aluminum panel with fixed edges, and eight arbitrarily positioned actuators whose positions are indicated by black dots.
Figure 30:
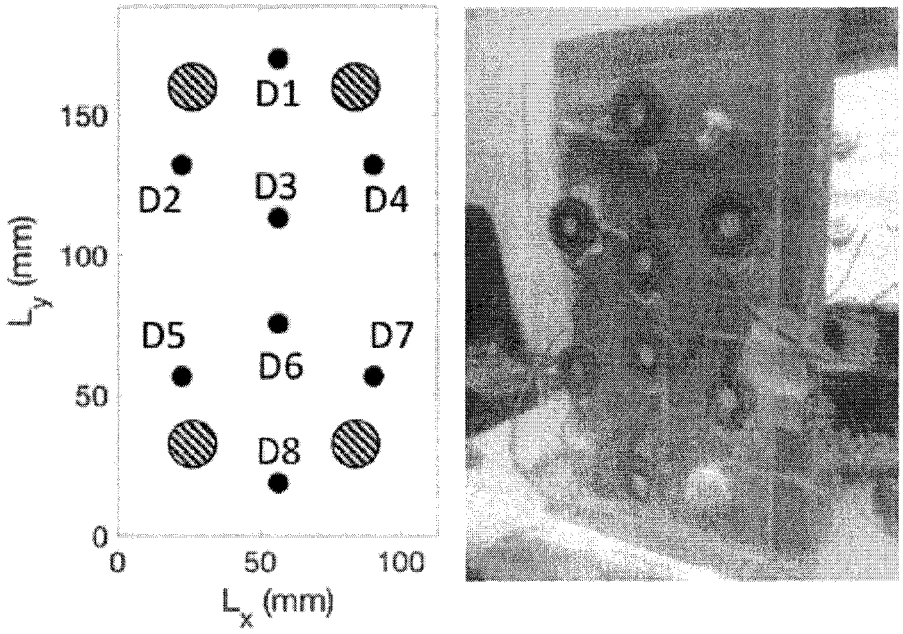
FIG. 30 shows an acrylic panel on four standoffs, with eight arbitrarily positioned actuators. The standoff and actuator positions are indicated by shaded circles, and black dots respectively.

The aluminum panel was constructed to approximate clamped boundary conditions, where the spatial response of each mode is nearly sinusoidal [A. K. Mitchell and C. R. Hazell, "A simple frequency formula for clamped rectangular plates," J. Sound Vib., vol. 118, no. 2, pp. 271-281, October 1987.]. The acrylic panel was supported by four standoffs, where each standoff is fixed approximately 2 cm in from each corner of the panel, and has a diameter of 1 cm. The boundary conditions in this case are not easily approximated analytically. The aluminum panel and the acrylic panel are shown with their corresponding actuator array layouts in FIGS. 29 and 30 respectively.

Filter Parameters

The vibration profile $\tilde{\varphi}_i(x, y)$ in response to excitation by each actuator individually was measured using a Polytec PSV-500 scanning laser vibrometer. The aluminum panel was measured over a frequency bandwidth of 4,000 Hz, to span the spatial Nyquist frequency of the driver array previously determined in [D. A. Anderson, M. C. Heilemann, and M. F. Bocko, "Optimized driver placement for array-driven flat-panel loudspeakers," Archives of Acoustics, vol. 42, no. 1, pp. 93-104, 2017]. The 2,000 Hz bandwidth used for the acrylic panel was determined empirically to span the spatial Nyquist frequency for the given driver array. Each actuator was powered by an independent Texas Instruments TPA3110D2 class-D amplifier channel.

Figures 31A, 31B:
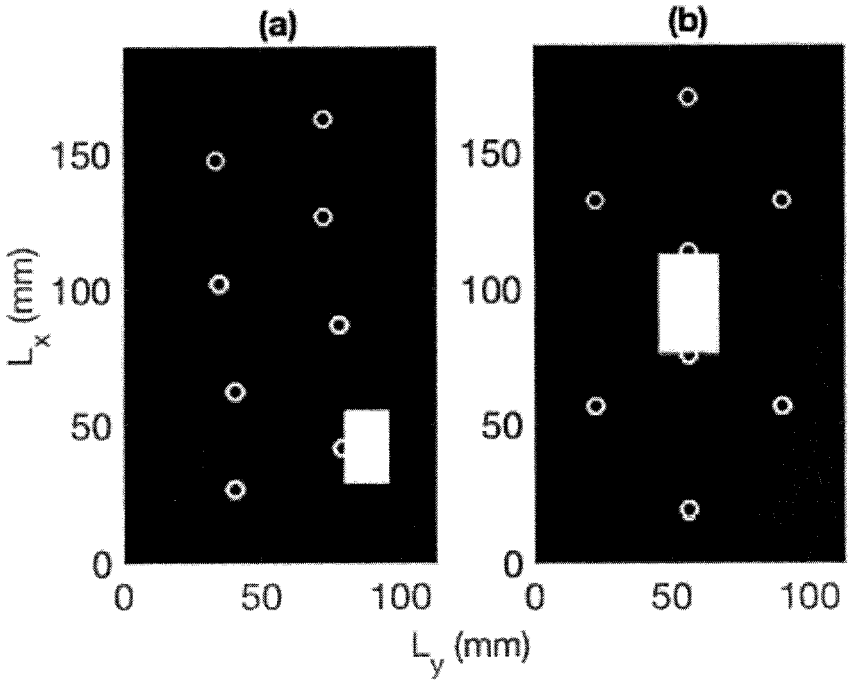
FIGS. 31A and 31B shows target acceleration profiles for the (FIG. 31A) aluminum and (FIG. 31B) acrylic panels. The actuator positions are indicated by white circles.

The target acceleration profiles for the panels are shown in FIG. 31. Each target acceleration profile is a rectangular region, where $\Psi(x, y)$ was given a normalized displacement value of unity inside the region, and zero outside the region. The target shape for the aluminum panel had dimensions 16:9 mm×28:4 mm, and was centered at (88:1 mm; 43:5 mm). The target shape for the acrylic panel needed to be shifted in location to avoid overlapping one of the standoffs. The target shape for the acrylic panel had dimensions $L_x/5 \times L_y/5$, and the center point was the middle of the panel.

Figure 32A:
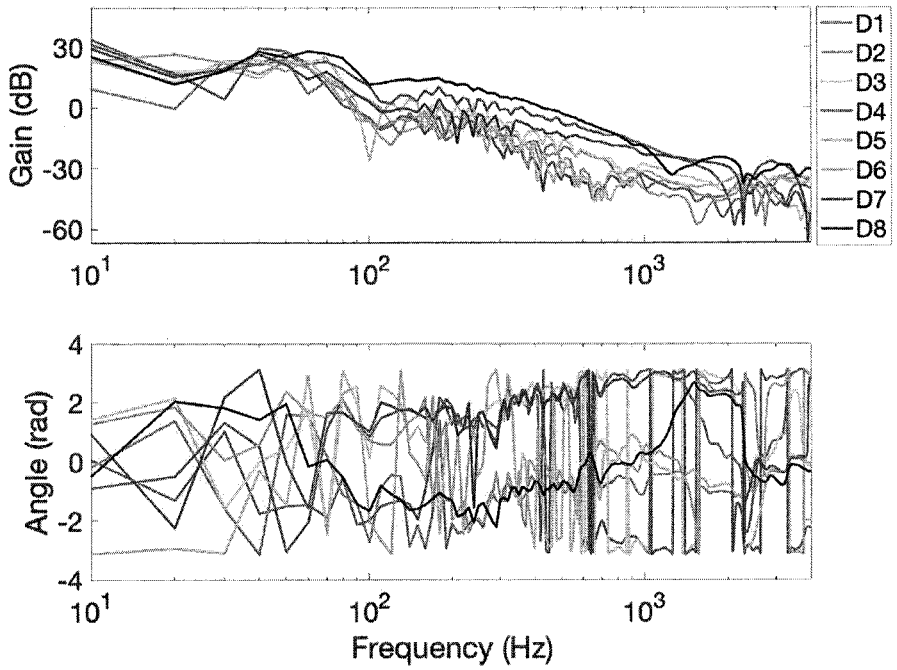
FIGS. 32A and 32B shows actuator filters for (FIG. 32A) the aluminum panel shown in FIG. 29 needed to render the target acceleration profile shown in FIG. 31A, and (FIG. 32B) the acrylic panel shown in FIG. 30 needed to render the target acceleration profile shown in FIG. 31B.
Figure 32B:
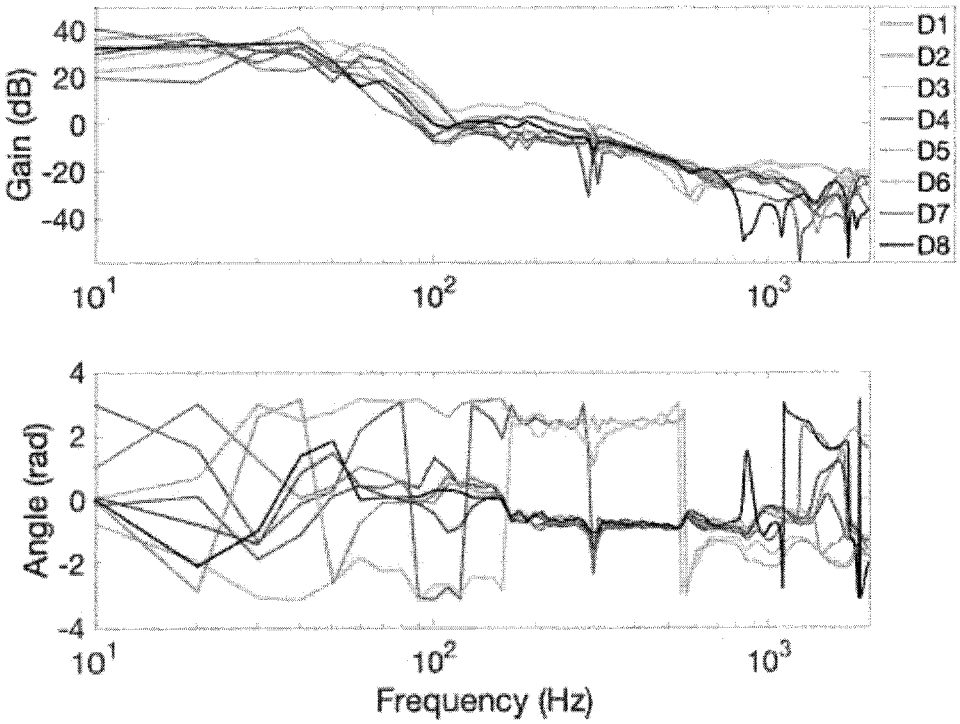

Following (31) the magnitudes and the phases of $\tilde{H}_i(\omega)$ needed to render the target acceleration profile for the acrylic panel is shown in FIG. 32 with 1/20th-octave smoothing. The magnitudes of the filters are presented in dB relative to 1 $ms^{-2}$. The filters for the aluminum panel are omitted for brevity, but exhibit similar characteristics to the acrylic panel filters.

The filters resulting from the optimization exhibit an observable magnitude and phase variability at low frequency, as the optimization routine compensates for the high variability in $\tilde{\varphi}_i(x, y, \omega)$ due to the internal resonances of the actuators themselves, which couple the bending modes of the panel. The mass loaded resonances of these actuators is approximately 130 Hz. In practice, care may be taken when designing panels to ensure that the bending modes resonate above the resonant frequencies of the actuators to minimize actuator-mode coupling and reduce the effects of uncontrolled resonances [J. Audio Eng. Soc., vol. 65, no. 9, pp. 722-732, 2017].

Results

The audio signal was filtered by $\tilde{H}_i(\omega)$ and sent to the respective actuators. The response of each panel was measured at different excitation frequencies using the scanning laser vibrometer. The acceleration responses of both panels are shown in FIG. 33 when all actuators are weighted by the specified filters $\tilde{H}_i(\omega)$. The acceleration response of the acrylic panel is also shown for excitation by actuator D3, since the mode shapes are not well defined for the given set of boundary conditions. A single actuator scan of the aluminum panel with fixed edges is omitted, as these boundary conditions are well known to give sinusoidal mode shapes (Fuller). The acceleration profiles are given in dB relative to the maximum acceleration at each frequency. Note that both panels were scanned from the front, so the source positions appear horizontally flipped compared to the targets. Since the aluminum panel has its lowest resonance at 401 Hz [M. C. Heilemann, D. Anderson, and M. F. Bocko, "Sound-source localization on flat-panel loudspeakers," J. Audio Eng. Soc, vol. 65, no. 3, pp. 168-177, 2017], the response of the panel is shown starting at 500 Hz to include frequencies where several different modes are excited.

For both the aluminum and acrylic panels, the rendered audio source holds its position at all frequencies below the spatial Nyquist frequency of the array. The MSE between the target response $\Psi(x, y)$ and the rendered spatial response is evaluated using (31), with the results shown in Table 1. In Table 1, MSE from (31) for each spatial response presented in dB relative the average acceleration of $\Psi(x, y)$ at frequencies $f_i$ shown in FIG. 33, where $f_1$ is lowest frequency reported for each scan, and $f_8$ is the highest reported frequency for each scan.

TABLE 1

Figures 33A, 33B, 33C, 33D:
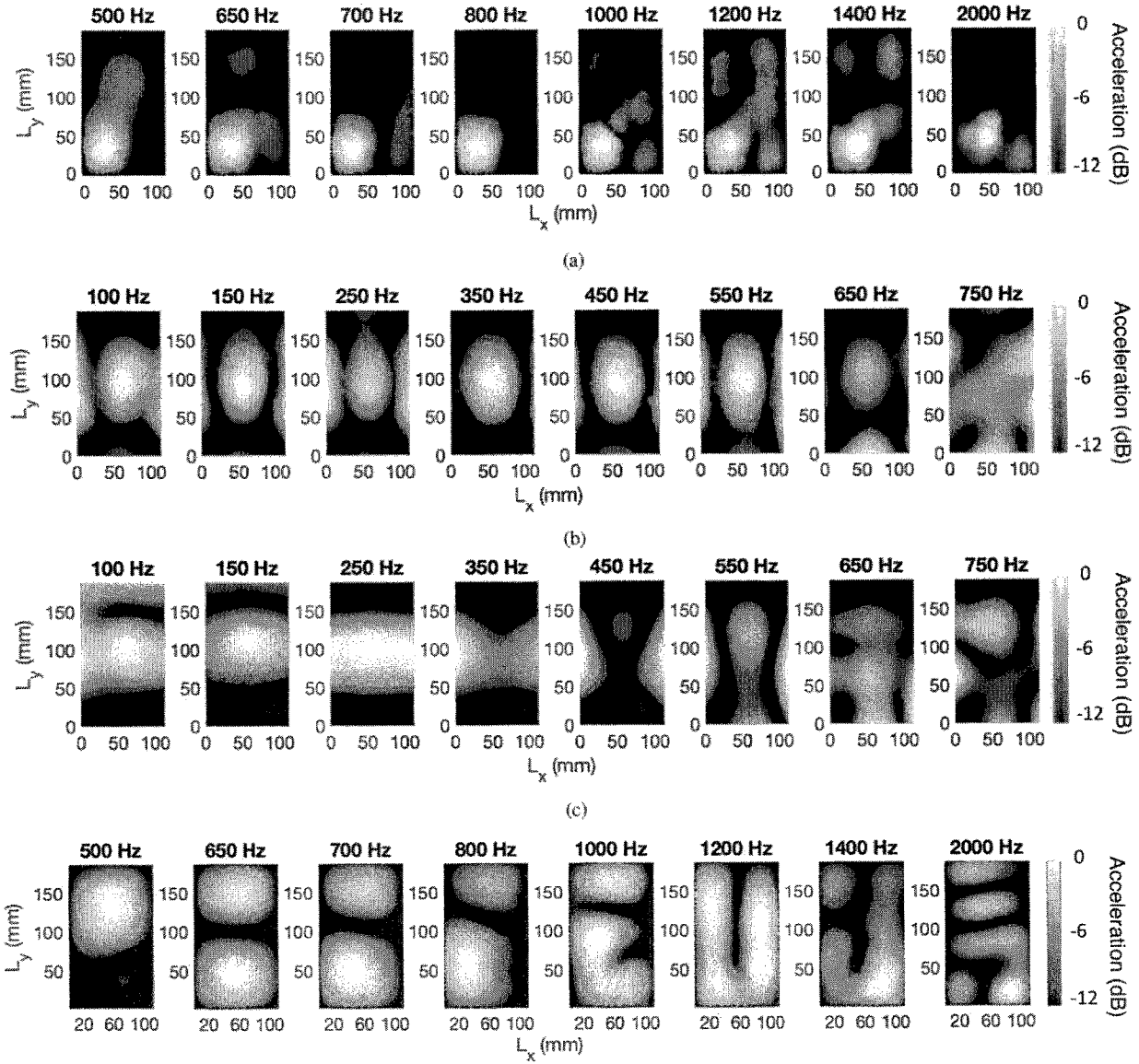
FIGS. 33A- and 33B shows spatial acceleration response of the (FIG. 33A) aluminum, and (FIG. 33B) acrylic panels, where all actuators are weighted by the appropriate filter $\tilde{H}_j(\omega)$.
(FIG. 33C) spatial acceleration response of the acrylic panel excited by the single actuator D3.
(FIG. 33D) spatial acceleration response of the aluminum panel excited by the single actuator D3. (Note that since the panels were scanned from the front, the source positions appear horizontally flipped compared to the target positions shown in FIG. 31.)

| Scan | $f_1$ | $f_2$ | $f_3$ | $f_4$ | $f_5$ | $f_6$ | $f_7$ | $f_8$ |
|---|---|---|---|---|---|---|---|---|
| FIG. 33A | 6.8 | 6.7 | 5.8 | 5.3 | 5.3 | 7.0 | 7.0 | 5.2 |
| FIG. 33B | 6.1 | 4.9 | 5.3 | 4.5 | 4.7 | 5.8 | 3.5 | 7.1 |
| FIG. 33C | 8.3 | 6.6 | 8.3 | 5.3 | 5.0 | 4.7 | 5.9 | 5.5 |
| FIG. 33D | 10.6 | 12.8 | 11.2 | 9.5 | 12.6 | 18.4 | 8.8 | 8.7 |

The MSE for the acrylic panel remains consistent for the excitation frequencies presented in this study, and increases when the excitation frequency exceeds the spatial Nyquist frequency of the actuator array as shown in FIG. 33*b* at 750 Hz. Although the acrylic panel displays a lower MSE for single actuator excitation than array excitation at 550 Hz, the average MSE across the reported frequencies for single actuator excitation is over 1 dB higher than the average MSE of array excitation. Though $\Psi(x, y)$ for the aluminum panel has a smaller vibrating surface area than $\Psi(x, y)$ for the acrylic panel, the reconstructions of these regions are both spatially band-limited by the eight drivers in each array, giving the aluminum panel a higher MSE than the acrylic panel relative to the average acceleration of each target region. The MSE in the actuator array cases could be further reduced by employing a greater number of force actuators on the panel to improve spatial resolution, or optimizing their placement to maximize the addressable bandwidth.

It is important to note that the spatial Nyquist frequency of the actuator array places a limit on the operational frequency bandwidth of this method. However, in an effect similar to the Schroeder frequency in room acoustics, vibrating panels undergo a transition in behavior from a low-frequency region to a high-frequency region. A crossover network may be utilized to ensure that low frequency audio sources are localized using the method described above, while high-frequency audio sources are localized naturally around a single force actuator due to high modal overlap in this region. This will allow sources encoded in an object-based format such as MPEG-H 3D to be rendered at their full bandwidth.

Tests employing the methods described above demonstrate that localized vibration regions may be rendered on the surface of a panel using filters designed using empirical measurements of the panel's vibration profile. This source rendering technique gives the potential to localize vibrations on the surfaces of displays such as laptop screens, televisions, and tablets, where the boundary conditions make the vibration profile of the system difficult to model in practice. These localized vibrations may serve as primary audio sources on the display screen and dynamically moved to new locations with their respective images, or held stationary on opposite sides of the panel to implement basic stereo imaging.

Localized Vibration Control Application to Smartphones

Figure 34A:
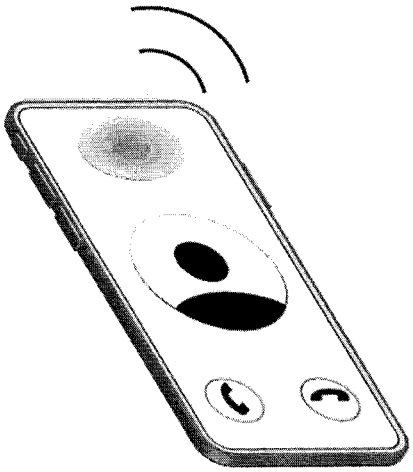
FIGS. 34A and 34B shows the application of the method of rendering localized vibrations on panels described herein to smartphones.
Figure 34B:
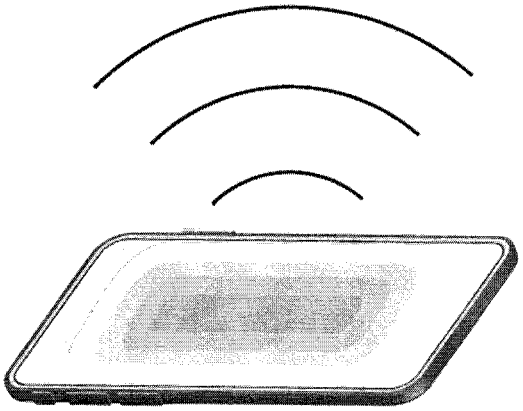

FIG. 34 shows two possible modes of operation for a smartphone enabled with localized vibration control of the smartphone display, which is serving as the loudspeaker. In 'handset mode', a confined region of the smartphone display where the user places their ear when making a phone call, is driven to vibrate and radiate sound. This affords the user privacy when making a call. In 'media mode' the entire screen is driven to vibrate and radiate sound. This increases the loudness and boosts the low-frequency audio response when employing the smartphone display as the loudspeaker. In media mode, the enhanced audio response improves the user experience for video-calls, for viewing videos, and for listening to music or other media.

In a particular embodiment, a device is built by computing the filters for a select set of target vibration profiles (speaker mode, handset mode, stereo mode, etc) and then a choice is made which target vibration profiles are used for each audio object given the situation. In certain embodiments, a look-up table of precomputed drive filters for a number of given vibration profiles is provided, which can then be superimposed.

It is possible to switch quickly between the handset and media modes, or among multiple modes with different display vibration profiles. This may be either by the user making a selection via the smartphone interface or switching could occur automatically by employing the smartphone camera (on the display side of the phone), the touchscreen of the phone, or any other means available on the smartphone to sense the proximity of the user's face to the phone, to select the appropriate mode.

While various embodiments have been described above, it should be understood that such disclosures have been presented by way of example only and are not limiting. Thus, the breadth and scope of the subject compositions and methods should not be limited by any of the above-described exemplary embodiments, but should be defined only in accordance with the following claims and their equivalents.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention, which is defined by the following claims. The claims are intended to cover the components and steps in any sequence which is effective to meet the objectives there intended, unless the context specifically indicates the contrary.

What is claimed is:

1. A method for using an array of force actuators to render a desired vibration profile on a panel, comprising the steps of:

determining by empiric measurement a vibration profile for the panel in response to excitation of each actuator individually, wherein the measurements are obtained at frequencies within the audio bandwidth;

selecting a target spatial vibration profile for the panel;

computing a filter for each actuator on the panel, wherein each filter governs the magnitude and phase response of the actuator versus frequency;

optimizing each filter for each actuator so that the superposition of the individual actuator responses best approximate the target spatial vibration profile;

generating the target spatial vibration profile on the panel by passing an audio signal through the optimized filters to each actuator in the array.

2. The method of claim 1, wherein the empiric measurement of a vibration profile is obtained by use of a laser vibrometer.

3. The method of claim 1, wherein the optimization minimizes the mean-square error or other perceptually weighted error metrics, between the target spatial vibration profile and the vibration profile generated by the superposition of the filtered individual actuator responses.

4. The method of claim 1, wherein the actuators are located on a smartphone screen.

5. The method of claim 1, wherein the audio signal is spatially tied to one or more selected from the group consisting of a portion of an image associated with a display and a portion of a video associated with a display.

6. The method of claim 1, wherein a frequency crossover network is used to separate the audio signal into different frequency bands, with each frequency band simultaneously reproduced through different target spatial vibration profiles.

7. The method of claim 1, wherein the actuators are located on the back of a monolithic display stack such as an organic light emitting diode (OLED), quantum-dot based light emitting diode such as QLED, e-paper, or other monolithically constructed display.

8. The method of claim 1, wherein at least a portion of the plurality of actuators are transparent to a visible part of the electromagnetic spectrum.

9. The method of claim 1, further comprising positioning the plurality of actuators on the panel in a predetermined arrangement, wherein the predetermined arrangement comprises the actuators being arranged around the perimeter of the panel.

10. The method of claim 9, wherein actuators are positioned underneath a bezel associated with the perimeter of the panel.

11. A system for rendering localized vibrations of a panel, comprising:

a functional portion of a display;

a panel comprising a plurality of actuators forming an arrangement on the panel, wherein the panel is an audio layer and a functional portion of the display is proximate to the audio layer; and a processor and a memory having instructions stored thereon, wherein execution of the instructions by the processor causes the processor to:

receive a shape function and an audio signal;

pass the audio signal through optimized filters to each actuator to generate localized vibrations in the panel, wherein the optimized filters have been determined according to the method of claim 1.

12. The system of claim 11, wherein the audio layer is laminated onto at least a portion the functional portion of the display.

13. The system of claim 11, wherein the functional portion of the display is selected from the group consisting of a liquid crystal display (LCD), a light-emitting diode display (LED), and an organic light-emitting diode display (OLED), a quantum-dot based light emitting diode (QLED), a plasma display, e-paper, or a monolithically constructed display.

14. The system of claim 11, wherein a spacer element can exist between the audio layer and the functional portion of the display.

15. The system of claim 11, wherein at least a portion of the audio layer is positioned between a touch panel and at least a portion of the functional portion of the display.

16. The system of claim 11, wherein the plurality of actuators are positioned on the panel in a predetermined arrangement, and wherein the predetermined arrangement may exhibit translational or rotational symmetry or may be random.

17. The system of claim 11, wherein a confined region of the functional portion of the display is driven to vibrate and radiate sound.

18. The system of claim 11, wherein the entire region of the functional portion of the display is driven to vibrate and radiate sound.

19. A method for the generation of an audio scene by methods such as wave field synthesis by rendering localized vibrations of a panel, comprising:

receiving an audio signal;

receiving one or more distance cues such as the amount of reverberant sound associated with a virtual acoustic source, wherein the virtual acoustic source is representative of an acoustic source behind a panel;

computing one or more acoustic wave fronts at one or more predetermined locations on the panel;

determining optimized filters for an array of actuators forming an arrangement on a panel according to the method of claim 1;

generating localized vibrations in the panel by passing an audio signal through the optimized filters to each actuator in the array.

20. The method of claim 19, wherein the audio signal is spatially tied to one or more portions of at least portion of an image and video associated with a display.

* * * * *